US006429365B1

(12) United States Patent
Ide et al.

(10) Patent No.: US 6,429,365 B1
(45) Date of Patent: Aug. 6, 2002

(54) PERFORMANCE CONTROL APPARATUS AND METHOD CAPABLE OF SHIFTING PERFORMANCE STYLE DURING PERFORMANCE

(75) Inventors: Kensuke Ide; Shuzo Karakawa; Shigehiko Mizuno, all of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/650,197

(22) Filed: Aug. 29, 2000

(30) Foreign Application Priority Data

Sep. 3, 1999 (JP) ..... 11-249781

(51) Int. Cl.[7] ..... G10H 1/40
(52) U.S. Cl. ..... 84/635; 84/DIG. 12
(58) Field of Search ..... 84/611, 612, 635, 84/636, DIG. 12

(56) References Cited

U.S. PATENT DOCUMENTS 4,481,853 A * 11/1984 Ishikawa ..... 84/DIG. 12
4,763,554 A 8/1988 Kozuki
4,839,810 A * 6/1989 Abe ..... 84/DIG. 12
4,887,503 A 12/1989 Suzuki
5,085,118 A * 2/1992 Sekizuka ..... 84/635
5,502,275 A 3/1996 Kondo
5,756,917 A * 5/1998 Watanabe ..... 84/635 X
5,920,025 A * 7/1999 Itoh et al. ..... 84/611

* cited by examiner

*Primary Examiner*—Stanley J. Witkowski
(74) *Attorney, Agent, or Firm*—Morrison & Foerster LLP

(57) ABSTRACT

During reproduction of performance data in a particular performance style, an instruction can be given for shifting the reproduction to another performance style. In response to such a performance style shift instruction, the performance data of one or more of the performance parts of the currently-reproduced performance style is sequentially controlled, through a plurality of stepwise shift phases, to be replaced with the performance data of one or more of the performance parts of a designated shifted-to performance style. Thus, when the performance style is to be shifted during performance, the performance style shift can be effected in a smooth manner by gradually switching the performance data on a performance-part-by-performance-part basis.

23 Claims, 15 Drawing Sheets

| SHIFT PHASE | | 0 | 1 | 2 | E |
|---|---|---|---|---|---|
| SHIFTED-FROM STYLE | TR1 | 1 | 0 | 0 | 0 |
| | TR2 | 1 | 1 | 0 | 0 |
| | TR3 | 1 | 1 | 1 | 0 |
| SHIFTED-TO STYLE | TR1 | 0 | 1 | 1 | 1 |
| | TR2 | 0 | 0 | 1 | 1 |
| | TR3 | 0 | 0 | 0 | 1 |

PERFORMANCE CONTROL APPARATUS AND METHOD CAPABLE OF SHIFTING PERFORMANCE STYLE DURING PERFORMANCE

BACKGROUND OF THE INVENTION

The present invention relates generally to electronic musical instruments, automatic performance apparatus and other types of performance apparatus which read out performance data prestored with a plurality of performance parts associated with a plurality of tracks, and reproduce tones on the basis of the read-out performance data. More particularly, the present invention relates to an improved performance control apparatus and method which, during reproduction of predetermined performance data, allows the currently-reproduced predetermined performance data to be shifted gradually to other performance data on a performance-part-by-performance-part basis, rather than simultaneously for all the performance parts.

Conventionally-known music performance apparatus, such as electronic musical instruments or automatic performance apparatus, are generally constructed to prestore a multiplicity of sets of performance data and then execute an automatic performance on the basis of a selected one of the prestored performance data sets. In response to an operation of a panel switch during automatic performance of given performance data, the performance apparatus can perform tones while successively changing or shifting the performance data to be automatically performed. In these music performance apparatus, a plurality of performance parts (such as drum, bass and chord-backing parts) of each performance data set are associated with, or set to correspond to, a plurality of predetermined tracks.

However, because the conventionally-known music performance apparatus, e.g., an apparatus as shown in U.S Pat. Nos. 4,763,554, 4,887,503 and 5,502,275, can only effect a shift from the currently-performed (reproduced) performance data to other performance data simultaneously or collectively for all the performance parts, the performance style would shift simultaneously in all the performance parts, which thus results in an unnatural performance change.

SUMMARY OF THE INVENTION

It is therefore an object of the present invention to provide an improved performance control apparatus and method which, during performance of predetermined performance data, allow the currently-performed predetermined performance data to be shifted gradually to another performance data in response to a performance style shift instruction.

In order to accomplish the above-mentioned object, the present invention provides a performance control apparatus which comprises: a memory storing sets of performance data for a plurality of performance parts, in association with a plurality of performance styles; an instruction generator adapted to issue a performance style shift instruction; and a processor coupled with the memory and the instruction generator and adapted to: read out, from the memory, the performance data corresponding to a desired one of the performance styles and reproduce performance tones of two or more of the performance parts on the basis of the read-out performance data; and control, in response to the instruction issued by the instruction generator for changing a currently-reproduced performance style to another performance style, the performance data of one or more of the performance parts of the currently-reproduced performance style so as to be replaced with the performance data of one or more of the performance parts of a shifted-to performance style through a plurality of stepwise shift phases. The processor thereby gradually replaces the performance parts of the currently-reproduced performance style with the performance parts of the shifted-to performance style.

A plurality of sets of performance data are prestored in the memory, each of which comprises data characterizing a music piece to be performed. By designating a desired one of the performance data sets, the music piece can be performed in a particular performance style based on the designated performance data. When a user wants the performance executed in a different performance style from that of the currently performed (reproduced) performance data, the user can give a performance style shift instruction via the instruction generator. The instruction generator in this invention comprises, for example, a suitable operator such that by operating the operator, the user can instruct that the currently reproduced performance data be changed over to other performance data (i.e., "shifted-to" performance data). Once such a performance style shift instruction is issued, the reproduction process is controlled so as to reproduce the performance data while sequentially effecting a shift from the currently-reproduced (i.e., "shifted-from") performance data to the shifted-to performance data on a performance-part-by-performance-part basis, rather than simultaneously or collectively for all the performance parts. The processor can read out, from the memory, the performance data of the shifted-from and shifted-to performance styles individually for each of the performance parts, and then simultaneously reproduce the read-out performance data of the shifted-from and shifted-to performance styles in a mixed fashion. Namely, whenever desired, the present invention allows the performance data to be gradually shifted, individually for each of the performance parts or on the performance-part-by-performance-part basis. The instruction generator may be implemented by any appropriate data generating means other than the manually-operable operator, such as instruction data that is incorporated in an automatic performance sequence and read out in accordance with progression of the automatic performance.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the present invention may be implemented as a machine-readable storage medium storing performance data based on the principles of the invention. Furthermore, the processor used in the present invention may comprise a dedicated processor based on predetermined fixed hardware circuitry, rather than a CPU or other general-purpose type processor capable of operating by software.

BRIEF DESCRIPTION OF THE DRAWINGS

For better understanding of the object and other features of the present invention, its preferred embodiments will be described in greater detail hereinbelow with reference to the accompanying drawings, in which.

DETAILED DESCRIPTION OF THE PREFERRED EMBODIMENTS

Figure 1:
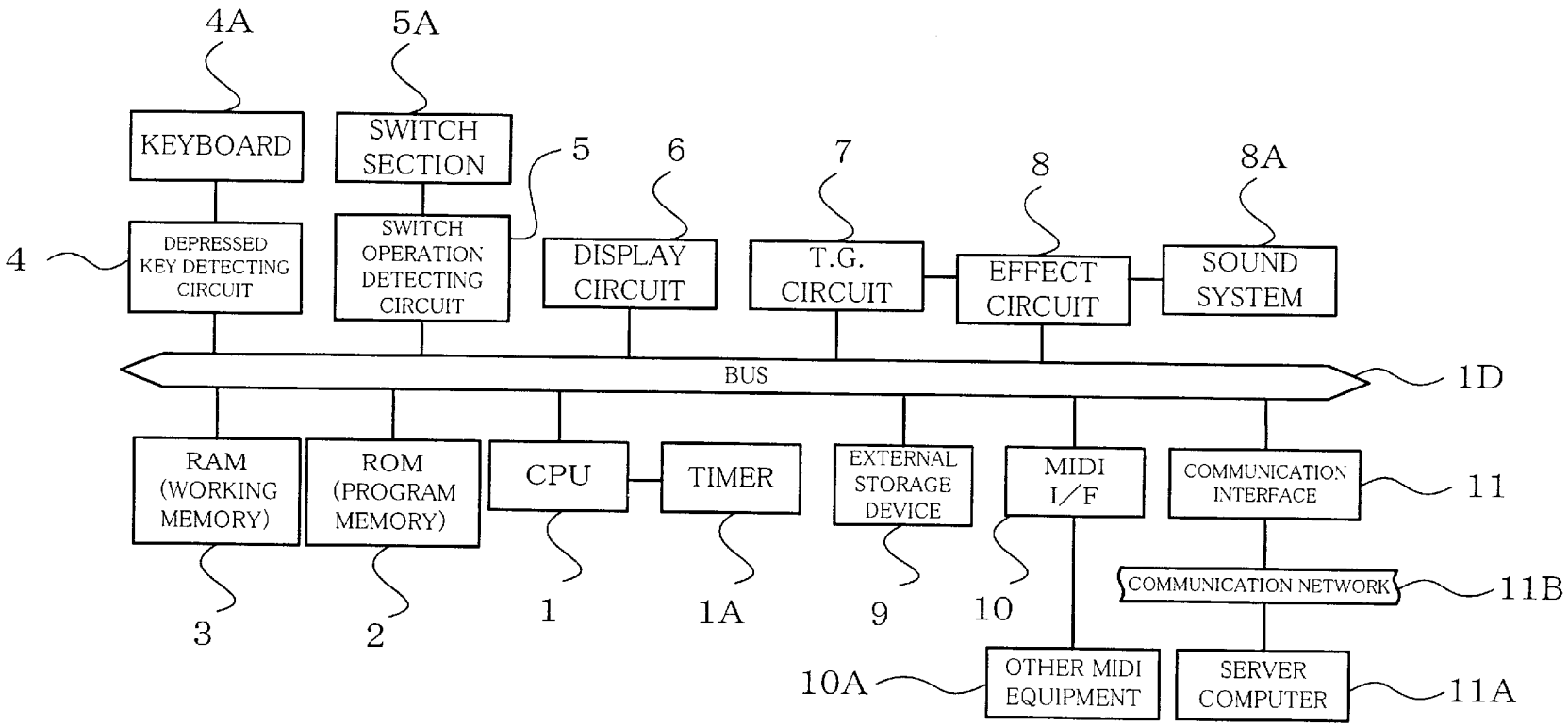
FIG. 1 is a block diagram illustrating a general hardware setup of an electronic musical instrument having incorporated therein a performance control apparatus according to an embodiment of the present invention.

FIG. 1 is a block diagram illustrating a general hardware setup of an electronic musical instrument having incorporated therein a performance control apparatus according to an embodiment of the present invention.

This electronic musical instrument is controlled by a microcomputer comprising a microprocessor unit (CPU) 1, a program memory 2 and a working memory 3. The CPU 1 controls operation of the entire electronic musical instrument. To the CPU 1 are connected, via a data and address bus 1D, the program memory 2, working memory 3, depressed key detecting circuit 4, switch operation detecting circuit 5, display circuit 6, tone generator (T.G.) circuit 7, effect circuit 8, external storage device 9, MIDI interface (I/F) 10 and communication interface 11. Also connected to the CPU 1 is a timer 1A for counting various time periods, for example, to signal interrupt timing for a timer interrupt process.

The program memory 2, which is a read-only memory (ROM), has prestored therein various programs and various data. The working memory 3, which is intended to temporarily store various performance-related information and various data generated as the CPU 1 executes the programs, is allocated in predetermined address regions of a random access memory (RAM) and used as registers, flags, etc. Keyboard 4A includes a plurality of keys for selecting a pitch of each tone to be generated and a plurality of key switches provided in corresponding relations to the keys. The keyboard 4A can be used not only for tone performance but also as means for inputting an instruction for a performance style shift (performance style shift instruction). The depressed key detecting circuit 4 detects each key depression and release to output key-on event data and key-off event data. Switch section 5A includes various operators for inputting a performance style shift instruction and various musical conditions pertaining to a music piece to be performed. For example, the switch section 5A may be a ten-button keypad for entry of numeric value data and a keyboard for entry of text data, or switch panel. The switch section 5A may also include operators for selecting, setting and controlling a tone pitch, color, effect, etc. The switch operation detecting circuit 5 constantly detects respective operational states of the individual operators on the switch section 5A and outputs switch information, corresponding to the detected operational states of the operators, to the CPU 1 via the data and address bus 1D. The display circuit 6 visually displays various information, such as controlling conditions of the CPU 1 and current settings, on a display that may comprise an LCD (Liquid Crystal Device) or CRT (Cathode Ray Tube).

The tone generator (T.G.) circuit 7, which is capable of simultaneously generating tone signals in a plurality of channels, receives MIDI data supplied via the data and address bus 1D and generates tone signals based on these received data. Each of the tone signals thus generated by the tone generator circuit 7 is audibly reproduced or sounded by a sound system 8A. The effect circuit 8 imparts various effects to the tone signals generated by the tone generator circuit 7. Any tone signal generation method may be used in the tone generator circuit 7, such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Other than the above-mentioned, the tone generator circuit 7 may also use the physical model method, harmonics synthesis method, formant synthesis method, analog synthesizer method using VCO, VCF and VCA. Further, the tone generator circuit 7 may be implemented by a combined use of a DSP and microprograms or of a CPU and software programs, rather than by use of dedicated hardware. The tone generation channels to simultaneously generate a plurality of tone signals in the tone generator circuit 7 may be implemented either by using a single circuit on a time-divisional basis or by providing a separate circuit for each of the channels.

The external storage device 9 is provided for storing performance data, such as style data and rhythm patterns, and data relating to control of the various programs for execution by the CPU 1. Where a control program is not prestored in the ROM 2, the control program may be prestored in the external storage device (e.g., hard disk device) 9, so that, by reading the control program from the external storage device 9 into the RAM 3, the CPU 1 is allowed to operate in exactly the same way as in the case where the control program is stored in the program memory 2. This arrangement greatly facilitates version upgrade of the control program, addition of a new control program, etc. The external storage device 9 may use any of various removable-type media other than the hard disk (HD), such as a floppy disk (FD), compact disk (CD-ROM or CD-RAM), magneto-optical disk (MO) or digital versatile disk (DVD).

The MIDI interface (I/F) 10 is provided for receiving or delivering MIDI performance information from or to other MIDI equipment 10A or the like outside the electronic musical instrument. Further, the communication interface 11 is connected to a communication network 11B, such as a LAN (Local Area Network), the Internet or telephone lines, via which it may be connected to a desired sever computer 11A so as to input a control program and various data to the electronic musical instrument. Thus, in a situation where the control program and various data are not contained in the ROM 2 or hard disk, these control program and data can be downloaded from the server computer 11A. In such a case, the electronic musical instrument, which is a "client", sends a command to request the server computer 11A to download the control program and various data by way of the communication interface 11 and communication network 11B. In response to the command from the client, the server computer 11A delivers the requested control program and data to the electronic musical instrument via the communication network 11B. The electronic musical instrument receives the control program and data via the communication interface 11 and accumulatively store them into the hard disk. In this way, the necessary downloading of the control program and various data is completed. Note that the MIDI interface 10 may be a general-purpose interface rather than a dedicated MIDI interface, such as RS232-C, USB (Universal Serial Bus) or IEEE1394, in which case other data than MIDI messages may be communicated at the same time.

Figure 2:
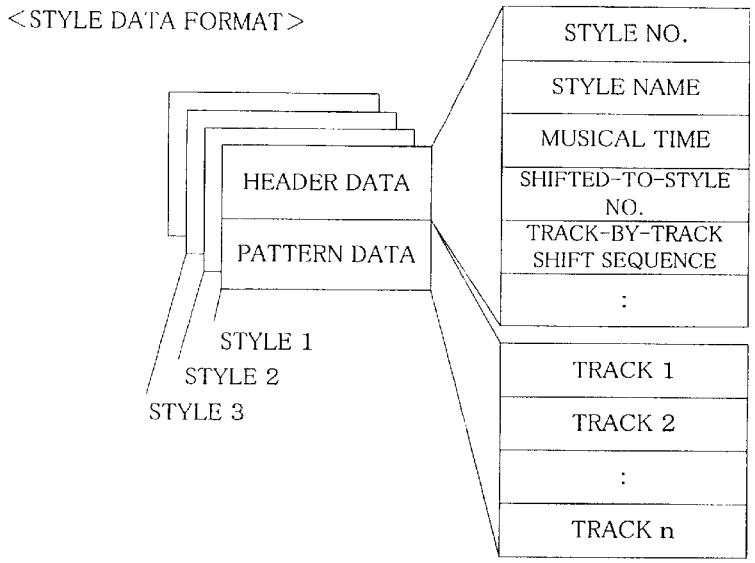
FIG. 2 is a block diagram conceptually showing an exemplary organization of style data employed in the embodiment of the present invention.

FIG. 2 is a block diagram conceptually showing an exemplary organization of style data sets employed in the present invention; note that the illustrated example is shown as including performance style shift information within the style data sets.

Each of the style data sets comprises header data and pattern data. The header data are parameter data that are common to the succeeding pattern data and include, for example, data indicative of a style number and name, musical time and performance style shift information (shifted-to style number and track-by-track, i.e., performance-part-by-performance-part, shift sequence). The performance style shift information (i.e., shifted-to style number and track-by-track shift sequence) may be set to different contents for each style data set or same contents for all the style data sets. The pattern data, on the other hand, include a plurality of track data (i.e., pattern data of individual tracks) 1–n which correspond to a plurality of performance parts such as drum, bass and chord-backing parts; for example, track data 1 (first track data) is performance pattern data for the drum part, track data 2 (second track data) is performance pattern data for the bass part, and track data 3 (third track data) is performance pattern data for the chord-backing part. In the described embodiment, the correspondency between the track data 1–n and the performance parts is the same for all the style data sets. Each of the track data 1–n is composed of combinations of note data and timing data. However, for the other performance parts than the drum part, the note data may be converted into one corresponding to a separately designated chord as necessary.

It should be appreciated that the style data may include other parameters than the above-mentioned, such as a tone color, tempo, number of measures, etc.

The "style number" is a number or mark uniquely identifying the style data set in question. The "style name" is a performance style name given to each style data set, such as "dance & pops (rap, Euro-beat, pop ballade, etc.)", "soul (dance funk, soul ballade, R & B, etc.)", "rock (soft eighth note rock feel, eighth note rock feel, rock'n' roll, etc.)", "jazz (swing, jazz ballade, jazz bossa noba, etc.)", "Latin (bossa noba, samba, rumba, beguine, tango, reggae, etc.)", "march", "enka" (Japanese popular ballade), "song for school children" or the like. The "musical time" indicates a four-four time, eight-eight time or the like. The "shifted-to style number" is a number indicating a style data set to which the performance is to be changed over or shifted, i.e., a unique number of a shifted-to style data set. Performance style shift is effected to a style data set having a style number as designated by the shifted-to style number, and the style data set is set to a same musical time as the preceding or shifted-from style data set. The "track-by-track shift sequence" indicates particular order in which the track data should be shifted as instructed; that is, in the performance style shift, allocation and subsequent reproduction of designated shifted-to style data to selected tracks is effected on a track-by-track basis (i.e., performance-part-by-performance-part basis) in accordance with the track-by-track shift sequence or order.

It should be appreciated that in the style data, the individual component data may be prestored dispersedly in scattered storage regions rather than in successive storage regions. For example, the header data and the pattern data may be prestored in separate memories. However, in this case, it is of course necessary to manage the dispersed data as successive data. For this purpose, there may be provided a table showing correspondency between the header data and the pattern data so that any style data sets are identifiable by reference to the table.

The following paragraphs describe an exemplary manner in which the pattern of the style data set is shifted.

Figure 3A:
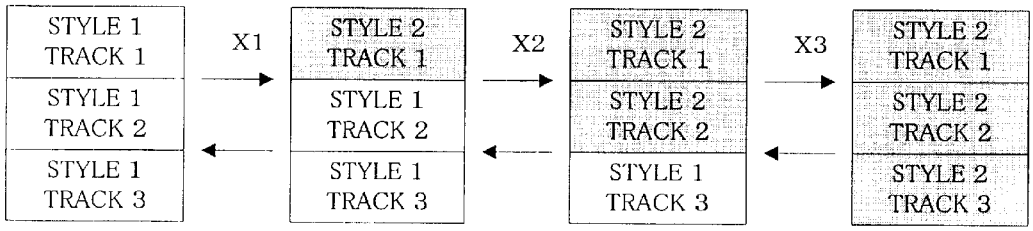
FIG. 3A is a diagram conceptually showing an example of a pattern shift in a case where track-by-track shift sequence is set as "1→2→3"
Figure 3B:
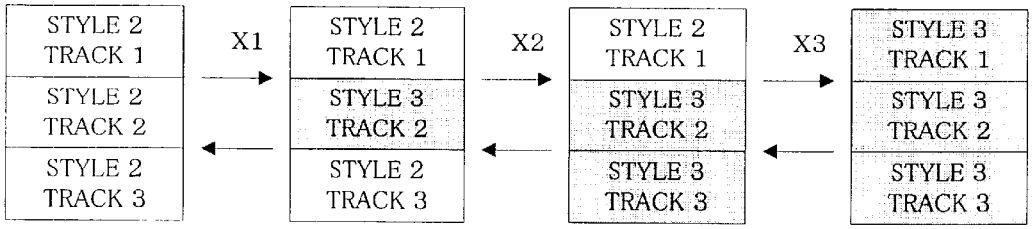
FIG. 3B is a diagram conceptually showing another example of the pattern shift in a case where the track-by-track shift sequence is set as "2→3→1"

FIG. 3A shows an example where the style number of a shifted-from style data set is "1", the style number of a shifted-to style data set is "2" and the track-by-track shift sequence is "1→2→3", and FIG. 3B shows another example where the style number of a shifted-from style data set is "2", the style number of a shifted-to style data set is "3" and the track-by-track shift sequence is "2→3→1". In both of FIGS. 3A and 3B, each of the shifted-from style data set and shifted-to style data set is shown as having three tracks. Note that the terms "shifted-from style" as used herein refer, in principle, to a performance style from which a current performance is changed over to another performance style that is called herein a "shifted-to style". Further, in each of FIGS. 3A and 3B, each shifted-from performance style is shown to the left of the corresponding shifted-to performance style.

Prior to a performance style shift, track data 1–3 are read out from the style data set of style number 1, as shown in FIG. 3A. Namely, all of track data 1–3 will be performed or reproduced in the same performance style (style 1). Namely, when a first performance style shift instruction is given, track 1 is shifted from style 1 to style 2 as denoted by arrow X1; that is, track data 1 is read out from the style data set of style number 2 and track data 2 and 3 are read out from the style data set of style number 1. Then, when a second performance style shift instruction is given, track 2 is shifted from style 1 to style 2 as denoted by arrow X2. Then, when a third performance style shift instruction is given, track 3 is shifted from style 1 to style 2 as denoted by arrow X3. Thus, after the performance style shift, track data 1–3 are all read out from the style data set of style number 2. Namely, all of track data 1–3 will be performed in the same No. 2 performance style.

Similarly, in the illustrated example of FIG. 3B, once a first performance style shift instruction is given, track 2 is shifted from style 2 to style 3 as denoted by arrow X1. Then, when a second performance style shift instruction is given, track 3 is shifted from style 2 to style 3 as denoted by arrow X2. Then, when a third performance style shift instruction is given, track 1 is shifted from style 2 to style 3 as denoted by arrow X3.

In the above-mentioned manner, the instant embodiment can read out the data of a different performance style for each of the tracks, so that it can change the individual tracks to a same performance style sequentially or in a gradual manner.

Figure 4:
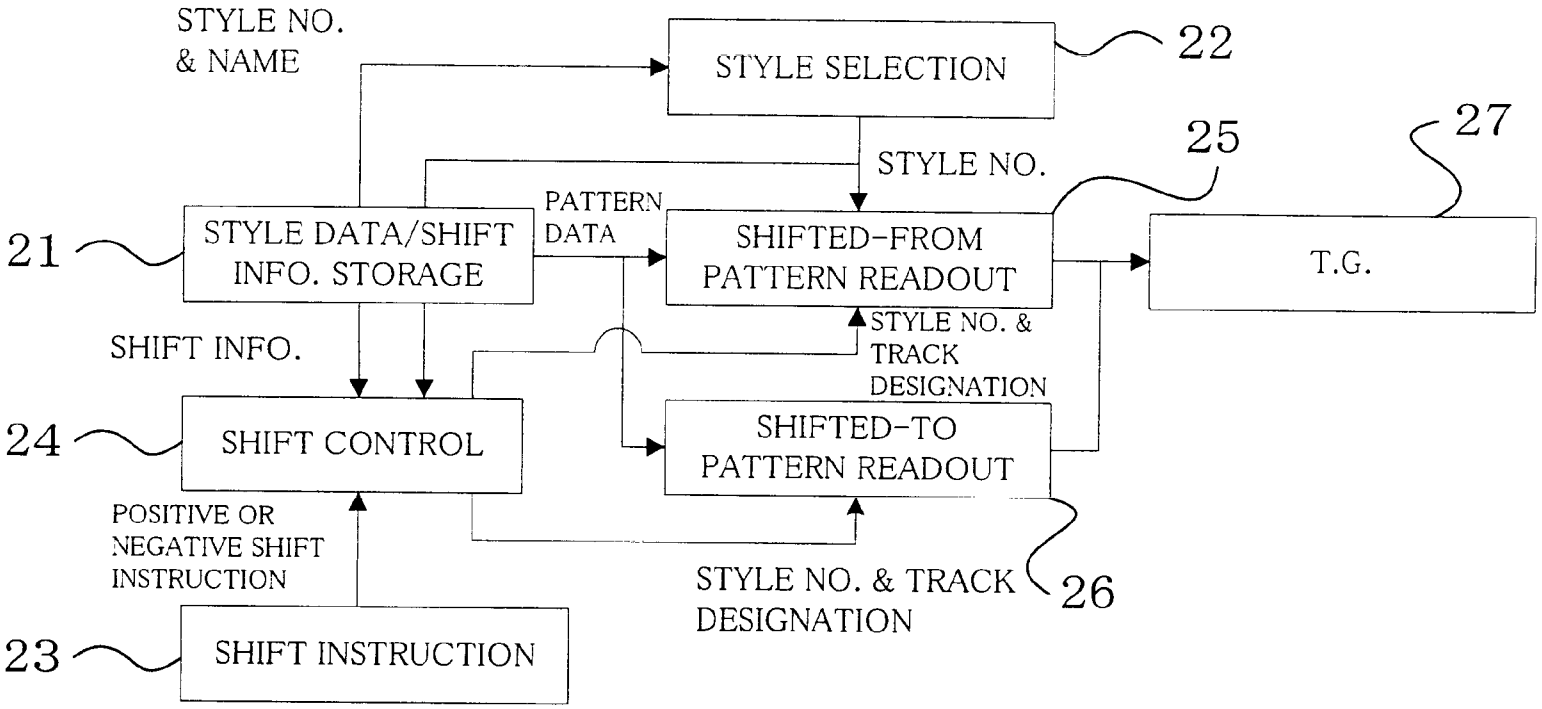
FIG. 4 is a functional block diagram showing exemplary functions of the performance control apparatus.

FIG. 4 is a functional block diagram showing exemplary functions of the inventive performance control apparatus, and these functions may be implemented here either by hardware or by software processing.

Style data/shift information storage section 21 is, for example, a ROM, RAM or external storage like a hard disk, which stores therein a multiplicity of the above-mentioned style data sets and performance style shift information (i.e., information representative of a shifted-to style number and track-by-track shift sequence). The style data sets and performance style shift information to be stored in the storage section 21 may be supplied from a maker of the performance control apparatus in question or may be recorded by a user. Style selection section 22 selects any one of the style data sets in accordance with designation by the user and sends the thus-selected style number to both a shifted-from patter readout section 25 and a shift control section 24. This style selection section 22 may comprise, for example, a ten-button keypad operable by the user to selectively designate a desired one of the style numbers, or a touch-sensitive panel having a display which allows the user to selectively designate a desired one of the style names or numbers visually shown on the display. Shift instruction section 23 is in the form of a switch or the like, which supplies the shift control section 24 with a positive performance style shift instruction ("performance style shift instruction +") for switching the current performance or reproduction to a shifted-to style data set, or a negative performance style shift instruction ("performance style shift instruction -") for moving back the performance to previous style data.

The shift control section 24 reads out, from the style data/shift information storage section 21, style data assigned the style number as designated by the style selection section 22, acquires a shifted-to style number and track-by-track shift sequence from the read-out style data, and then supplies a shifted-to pattern readout section 26 with the style number to be read as a shifted-to style. In accordance with the positive performance style shift instruction or negative performance style shift instruction, the shift control section 24 gives a track designating signal to the shifted-to pattern readout section 26 and shifted-from pattern readout section 25. If the track-by-track shift sequence is "1→2→3", the shift control section 24, in response to the first positive performance style shift instruction, instructs the shifted-from pattern readout section 25 to stop reading out track 1 and instructs the shifted-to pattern readout section 26 to start reading out track 1. In response to the second positive performance style shift instruction, the shift control section 24 instructs the shifted-from pattern readout section 25 to stop reading out track 2 and the shifted-to pattern readout section 26 to start reading out track 2. Further, once the negative performance style shift instruction is given, the shift control section 24 supplies the shifted-from pattern readout section 25 and shifted-to pattern readout section 26 with performance style shift instructions to the effects opposite to the above-mentioned, i.e. having the relationship between the start and stop of the track readout reversed from the above-mentioned instructions.

The shifted-from pattern readout section 25 reads out the style data of the style number having been designated by the style selection section 22 and supplies the read-out style data to a tone generator (T.G.) section 27. At an initial stage, i.e., at the time of first style data readout, the shifted-from pattern readout section 25 reads out the pattern data (specifically, track data) of all the tracks. Then, in accordance with the track designating signal from the shift control section 24, the shifted-from pattern readout section 25 controls the track to be read out. For example, if the given instruction is for stopping the readout of track 1, the shifted-from pattern readout section 25 stops the readout of track 1. Note that the track readout control may be performed by not supplying the read-out pattern data to the tone generator section 27 without actually stopping the readout. The shifted-to pattern readout section 26 reads out the style data of the style number having been designated by the shift control section 24 and then supplies the read-out style data to the tone generator section 27. At an initial stage, i.e., at the time of first style data readout, the shifted-to pattern readout section 26 does not read out the pattern data (specifically, track data) of any track. Then, in accordance with the track designating signal from the shift control section 24, the shifted-to pattern readout section 26 controls the track to be read out. For example, if the given instruction is for starting readout of track 1, the shifted-to pattern readout section 26 starts reading out track 1. Alternatively, the track readout control may be performed by reading out the pattern data of all the tracks at the initial stage but supplying the read-out pattern data to the tone generator section 27 only when the readout start is instructed without actually stopping the data readout.

The tone generator section 27 generates tones in accordance with the shifted-from and shifted-to pattern data supplied in the above-mentioned manner; this section 27 is capable of simultaneously generating tones of a plurality of the tracks.

Figure 5A:
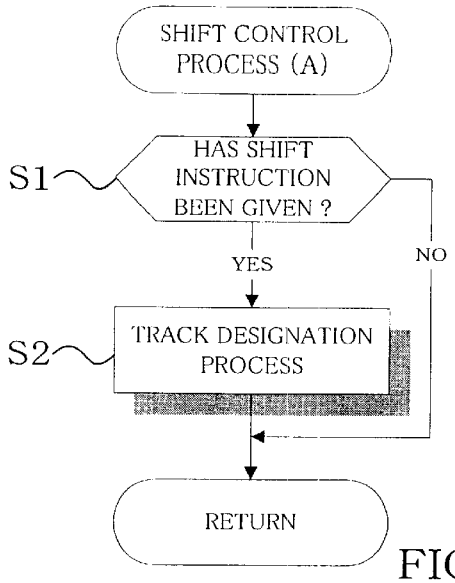
FIG. 5A is a flow chart showing an example of a shift control process which is arranged to issue a track designating signal the moment a performance style shift instruction is issued.
Figure 5B:
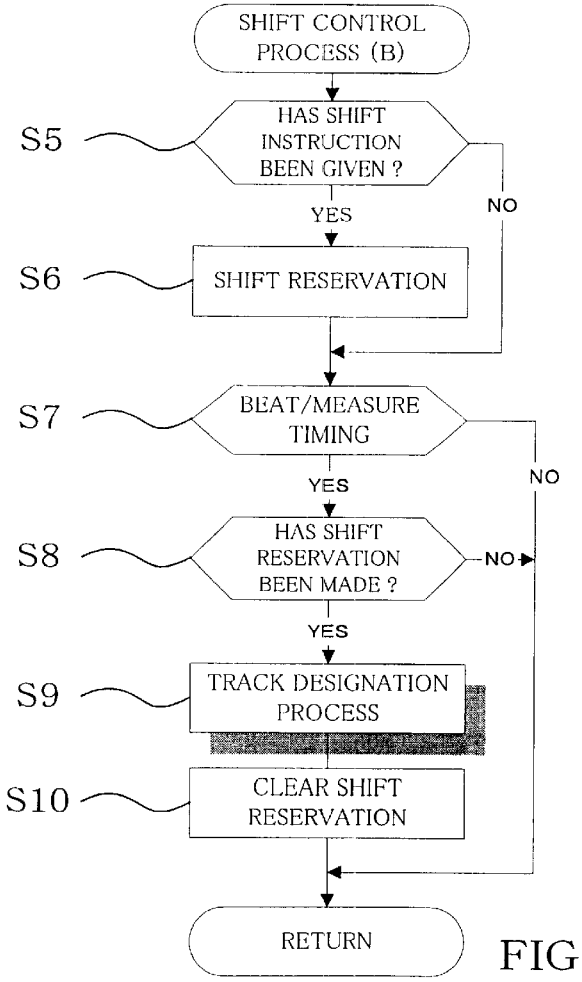
FIG. 5B is a flow chart showing another example of the shift control process which is arranged to issue a track designating signal the moment beat or measure timing is reached after issuance of the performance style shift instruction.
Figure 5C:
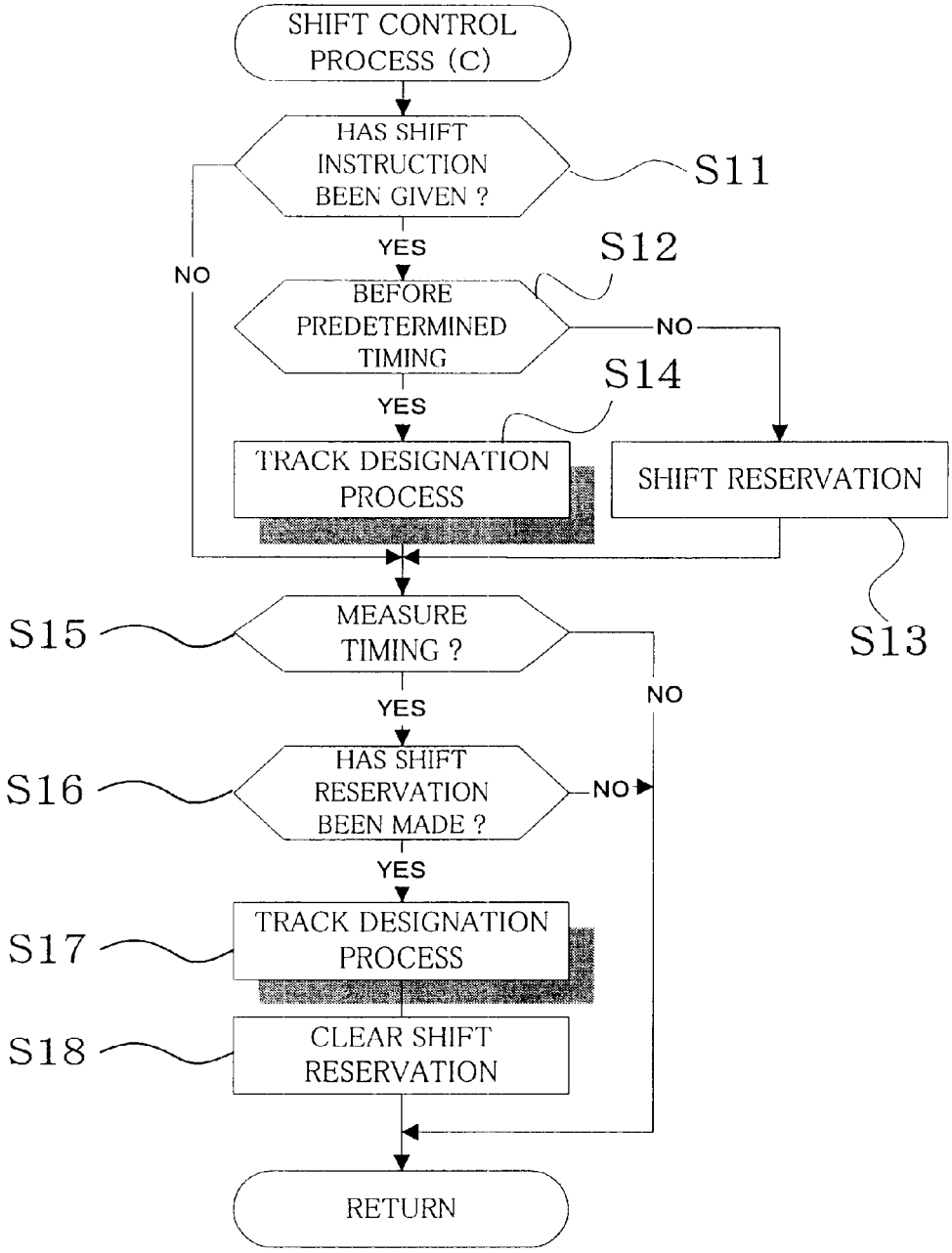
FIG. 5C is a flow chart showing still another example of the shift control process which is arranged to issue a track designating signal before or after predetermined timing within a measure.

FIGS. 5A, 5B and 5*c* are flow charts showing several examples of a shift control process that is carried out by the above-mentioned shift control section 24. Specifically, FIG. 5A shows an example of the shift control process where a track designating signal is issued the moment a performance style shift instruction is issued, and FIG. 5B shows another example of the shift control process where a track designating signal is issued at the instant when beat or measure timing is reached after issuance of a performance style shift instruction. Further, FIG. 5C shows still another example of the shift control process where a track designating signal is issued immediately if generation timing of the track designating signal is before predetermined timing (i.e., third beat timing) within a measure but is issued at next measure timing if the track designating signal timing is after the predetermined timing. Each of these examples of the shift control process is performed per predetermined cycle (e.g., every time interrupt process), and the predetermined cycle may be set either in accordance with a currently-set performance tempo or without regard to the performance tempo. As an example, each of the examples of the shift control process may be performed at intervals of 1/96 of a quarter note.

First describing the shift control process of FIG. 5A, it is determined at step S1 whether or not a performance style shift instruction has been given. If no such performance style shift instruction has been given (i.e., NO determination at step S1), there is no need to effect a shift in the currently-reproduced style data set, so that the shift control process is terminated without performing any other operations. If, on the other hand, such a performance style shift instruction has been given (YES determination at step S1), a track designation process is carried out at step S2 as will be detailed later. Namely, in this case, a track designating signal is issued immediately upon determination that the performance style shift instruction has been given, to effect the shift in the style data set.

In the shift control process of FIG. 5B, it is determined at step S5 whether or not a performance style shift instruction has been given. If such a performance style shift instruction has been given (YES determination at step S5), a reservation is made for the instructed performance style shift at step S6. If, however, no such performance style shift instruction has been given (NO determination at step S5), the shift control process jumps to step S7, where a further determination is made as to whether the current performance is presently at beat or measure timing. With a NO determination at step S7, the shift control process is terminated without effecting the performance style shift. If the performance is currently at beat or measure timing (YES determination at step S7), it is further determined whether or not a performance style shift reservation has already been made, at step S8. If no performance style shift reservation has been made yet as determined at step S8, the shift control process is terminated without executing any other operations. If, on the other hand, such a performance style shift reservation has already been made (YES determination at step S8), the track designation process is carried out at step S9 as will be described later in detail. Then, the shift control process is terminated after the performance style shift reservation is cleared. By thus arranging the shift control process to effect the performance style shift at predetermined timing after the issuance of the performance style shift instruction rather than immediately upon the issuance of the performance style shift instruction, the user is allowed to given a performance style shift instruction at not-so-accurate timing.

Further, in the shift control process of FIG. 5C, it is determined at step S11 whether or not a performance style shift instruction has been given. If no such performance style shift instruction has been given (NO determination at step S11), the shift control process jumps to step S15. If, however, such a performance style shift instruction has been given (YES determination at step S11), a further determination is made at step S12 as to whether the performance style shift instruction has been given prior to predetermined timing. With a NO determination at step S12, a reservation is made for the instructed performance style shift at step S13. If, however, the performance style shift instruction has been given prior to the predetermined timing (YES determination at step S12), then the track designation process is carried out at step S14 as will be described later in detail. Then, at step S15, a determination is made as to whether the issuance of the performance style shift instruction is at measure timing. With a NO determination at step S15, the shift control process is terminated without effecting the performance style shift. If, however, the issuance of the performance style shift instruction is at measure timing (YES determination at step S15), it is further determined whether or not a performance style shift reservation has already been made at step S16. If no performance style shift reservation has been made yet as determined at step S16, the shift control process is terminated without executing any other operations. If, on the other hand, such a performance style shift reservation has already been made (YES determination at step S16), the track designation process is carried out at step S17 as will be described later. Then, the shift control process is terminated after the performance style shift reservation is cleared at step S18. By thus varying the way of the performance style shift depending on whether the issuance of the performance style shift instruction is before or after predetermined timing within a measure, the performance style shift can be effected just as intended by the user. Let's, for example, consider a situation where a performance style shift instruction has been made before or after measure timing. If the performance style shift instruction has been made before measure timing in the case where a performance style shift is to be effected immediately in response to the performance style shift instruction, the track to be first shifted to another performance style ("first to-be-shifted track") will be performed only for a short period of time so that the performance will, in effect, be started with the second to-be-shifted track. If the performance style shift instruction has been made right after measure timing in the case where a performance style shift is to be effected at next measure timing after the issuance of the performance style shift instruction, performance of the first to-be-shifted track will be waited for a time corresponding to about one measure length. The shift control process of FIG. 5C arranged in the above-mentioned manner can provide good solutions to these inconveniences.

It should further be noted that the determinations as to whether the current timing is after or before predetermined timing and whether the current timing is beat or measure timing may be implemented by separately managing every current timing through a not-shown process. Further, whereas the preferred embodiment has been described above as performing the timing control (i.e., control for delaying the track designation till arrival at beat or measure timing after issuance of a performance style shift instruction) by means of the shift control section 24, the timing control may be performed by means of the shifted-from and shifted-to pattern readout sections 25 and 26 by passing the track designating signal to the pattern readout sections 25 and 26 immediately after the issuance of the performance style shift instruction).

Here, a performance style shift management table for use in the later-described track designation process will be explained briefly, with reference to FIG. 6 conceptually showing an exemplary data organization of the performance style shift management table. The performance style shift management table of FIG. 6 is shown as containing style data sets each of which has three tracks and track-by-track shift sequence of "1→2→3".

The performance style shift management table is created on the basis of the track-by-track shift sequence and stores, for each of a plurality of stepwise performance style shift phases (shift stages), information as to which of the tracks of shifted-from and shifted-to styles should be set to an ON or OFF state. The shift phase indicates a degree of performance style shift progress, and in the instant embodiment, there are used four degrees of performance style shift progress: "phase 0"; "phase 1"; "phase 2"; and "phase E". In the embodiment, "phase 0" represents a state prior to the first performance style shift (initial phase), and "phase E" represents a last shifted state. Further, in the table, a "shifted-from style" block represents states of shifting of the individual tracks from current or shifted-from style data, while a "shifted-to style" block represents states of shifting of the individual tracks to designated shifted-to style data. Shift state data "ON" (flag "1" in the illustrated example) is stored, at "phase 0", for all the tracks in the "shifted-from style" block, and shift state data "OFF" (flag "0" in the illustrated example) is stored, at "phase 0", for all the tracks in the "shifted-to style" block. Where the track-by-track shift sequence is "1→2→3" as in the illustrated example, track 1 is changed from the current or shifted from style over to the shifted-to style at the first performance style shift stage (phase 1), and thus shift state data "OFF" is stored for track 1 in the shifted-from style block while shift state data "ON" is stored for track 1 in the shifted-to style block. At the second performance style shift stage (phase 2), track 2 is changed from the shifted-from style over to the shifted-to style state, and thus shift state data "OFF" is stored for track 2 in the shifted-from style block while shift state data "ON" is stored for track 2 in the shifted-to style block. Further, at the third or last performance style shift stage (phase E), track 3 is changed from the shifted-from style over to the shifted-to style, and thus shift state data "OFF" is stored for track 3 in the shifted-from style block while shift state data "ON" is stored for track 3 in the shifted-to style block. Namely, at the last performance style shift stage denoted by "phase E", shift state data "OFF" is stored for all the tracks in the shifted-from style block of the table and shift state data "ON" is stored for all the tracks in the shifted-to style block of the table. In this way, the performance style shift management table stores ON/OFF states of the individual tracks as the performance style shift phase advances.

Figures 6, 7:
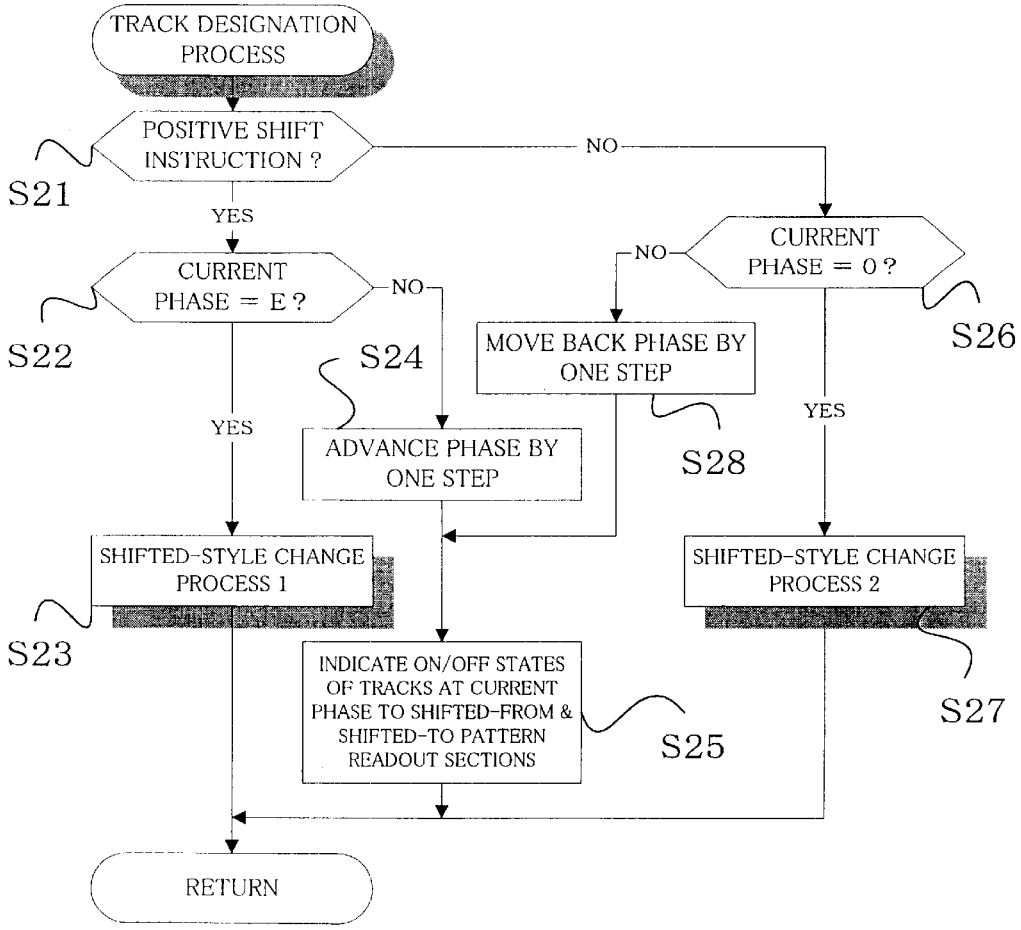
FIG. 6 is a diagram conceptually showing an exemplary general organization of a performance style shift management table employed in the performance control apparatus.
FIG. 7 is a flow chart showing exemplary details of a track designation process performed in each of the shift control processes of FIGS. 5A–5C.

FIG. 7 is a flow chart showing exemplary details of the track designation process performed in each of the shift control processes of FIGS. 5A–5C. Each time a performance style shift instruction is given, this track designation process determines respective ON/OFF states of the individual tracks with reference to the above-mentioned performance style shift management table and indicates the thus-determined ON/OFF states to the shifted-from and shifted-to pattern readout sections 25 and 26.

At first step S21, a determination is made as to whether or not the given performance style shift instruction is a positive (+) performance style shift instruction. If the given performance style shift instruction is a positive performance style shift instruction as determined at step S21 and the current shift phase is "phase E" (YES determination at next step S22), then "shifted-style change process 1" is carried out at step S23. If the current shift phase is not "phase E" (NO determination at step S22), then the current shift phase in the performance style shift management table is advanced by one step, i.e. to the next or immediately-following shift phase at step S24. Then, at step S25, the ON/OFF states of the individual tracks of the shifted-from style at the next shift phase are indicated to the shifted-from pattern readout section 25 and the ON/OFF states of the individual tracks of the shifted-to style are indicated to the shifted-to pattern readout section 26. If, on the other hand, the given performance style shift instruction is a negative (–) performance style shift instruction as determined at step S21 and the current shift phase is "phase 0" (YES determination at step S26), then "shifted-style change process 2" is carried out at step S27. If the current shift phase is not "phase 0" (NO determination at step S26), the current shift phase in the performance style shift management table is moved back by one step, i.e. to the immediately-preceding shift phase at step S28. Then, at step S25, the ON/OFF states of the individual tracks of the shifted-from style at the immediately-preceding shift phase are indicated to the shifted-from pattern readout section 25 and the ON/OFF states of the individual tracks of the shifted-to style are indicated to the shifted-to pattern readout section 26.

In case a further positive performance style shift instruction is given after the shift phase has advanced up to "phase E", the further positive performance style shift instruction may be ignored. In this case, the track designation process is terminated without executing shifted-style change process 1 of step S23. Similarly, in case a further negative performance style shift instruction is given at "phase 0", the further negative performance style shift instruction may be ignored. In this case, the track designation process is terminated without executing "shifted-style change process 2" of step S27.

Figure 8A:
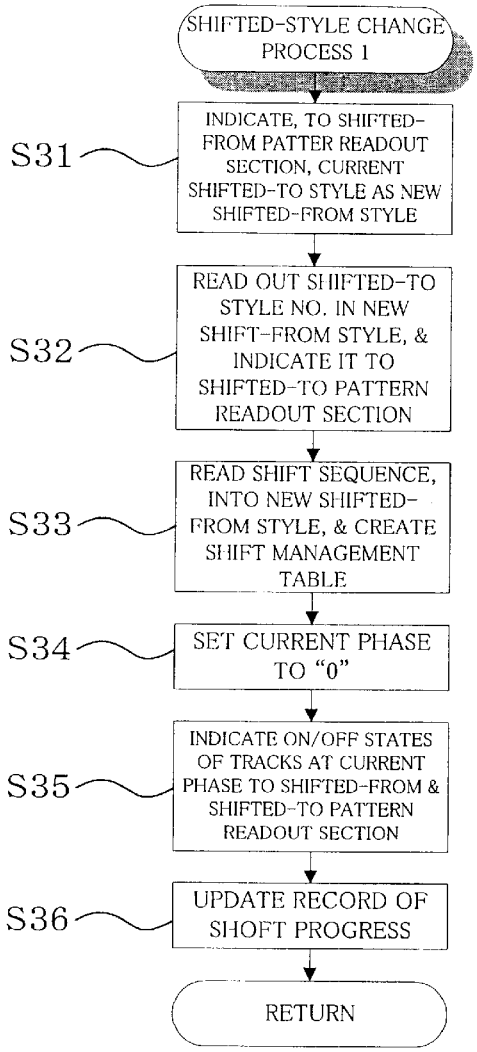
FIG. 8A is a flow chart showing an example of shifted-style change process 1 performed in the track designation process.

FIG. 8A is a flow chart showing a particular example of shifted-style change process 1 performed in the above-described track designation process.

First, at step S31, the current shifted-to style is indicated as a new shifted-from style to the shifted-from pattern readout section 25. Then, at step S32, the shifted-to style number in the new shifted-from style is read out and indicated to the shifted-to pattern readout section 26. After that, the track-by-track shift sequence is read out into the new shifted-to style, to create a performance style shift management table, at step S33. Then, the current shift phase is set to "phase 0" at step S34. At next step S35, the ON/OFF states of the individual tracks at the current shift phase are indicated to the shifted-from and shifted-to pattern readout sections 25 and 26. After that, record of performance style shift progress is updated at step S36 by storing the latest shifted-from style. For example, when the style has shifted in accordance the sequence of "1→2→4→3", "1, 2" is recorded as the record of performance style shift progress because the tracks have shifted with respect to the shifted-from style in the sequence of "1→2→4" while the tracks have shifted with respect to the shifted-to style in the sequence of "2→4→3".

Namely, when a further positive performance style shift instruction has been given after arrival at "phase E" (last phase), the latest shifted-to style data set becomes a new shifted-from style data set, so that the performance style shift further advances to another shifted-to style data set being established in the new shifted-from style data set. In this way, even when the performance style shift has been completed up to the last track, only giving a performance style shift instruction allows the performance to be automatically executed with the performance style shift advanced to a further next shifted-to style data set.

Figure 8B:
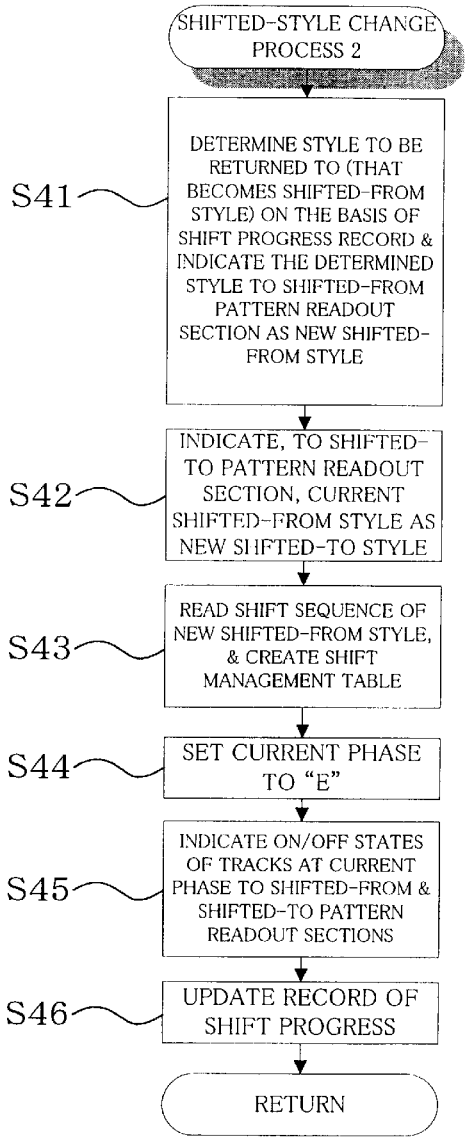
FIG. 8B is a flow chart showing an example of shifted-style change process 2 performed in the track designation process.

FIG. 8B is a flow chart showing an example of shifted-style change process 2 performed in the above-described track designation process.

At step S41, a performance style to be returned to (i.e., a performance style that will become a shifted from) is determined on the basis of the record of performance style shift progress, and the thus-determined style is indicated as a new shifted-from style to the shifted-from pattern readout section 25. Also, the current shifted-from style is indicated as a new shifted-to style to the shifted-to pattern readout section 26, at step S42. After that, the track-by-track shift sequence of the new shifted-from style is read out to create a performance style shift management table, at step S43, and the current shift phase is set to "phase E" at step S44. Then, at step S45, the ON/OFF states of the individual tracks at the current shift phase are indicated to the shifted-from and shifted-to pattern readout sections 25 and 26. Then, the record of performance style shift progress is updated at step S46 by deleting the new shifted-from style. For example, where "1, 2" is recorded as the record of performance style shift progress, the new shifted-from style to be deleted is "2", so that only "1" is kept recorded as the record of performance style shift progress. Note that if nothing is recorded as the record of performance style shift progress at the time of determination of the shifted-from style (step S41) (e.g., at the very initial stage or when the record of performance style shift has been deleted as mentioned above), no new shifted-from style is determined so that no performance style shift takes place.

Namely, when a negative (−) performance style shift instruction has been further given at "phase 0" (initial phase), a style to be returned to is determined in accordance with the record of performance style shift progress up to that time and the thus-determined style is set as a new shifted-to style data set. Also, the latest shifted-from style is set as a new shifted-to style. In this way, even when the performance style shift has been completed up to the first track in response to the instruction for returning the shift phase, the performance can be continued by changing to a further next shifted-from style data set. Because the performance style to be returned to is determined in accordance with the record of performance style shift progress, the performance style can be returned just in conformity with the record of performance style shift progress.

Figure 8C:
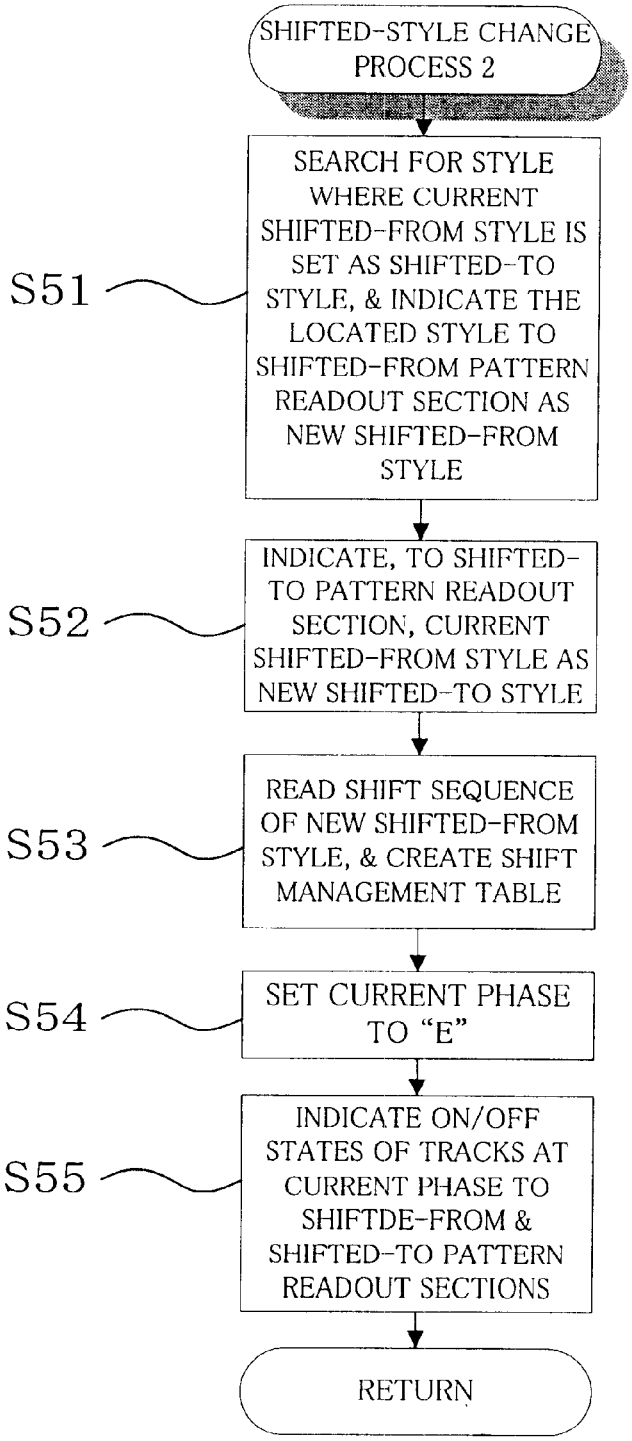
FIG. 8C is a flow chart showing another example of shifted-style change process 2 performed in the track designation process.

FIG. 8C is a flow chart showing another example of shifted-style change process 2 performed in the above-described track designation process.

First, at step S51, a search is made for a style where the current shifted-from style is set as a shifted-to style and the located style is indicated as a new shifted-from style to the shifted-from pattern readout section 25. Also, the current shifted-from style is indicated as a new shifted-to style to the shifted-to pattern readout section 26, at step S52. After that, the track-by-track shift sequence of the new shifted-from style is read out to create a performance style shift management table, at step S53, and the current shift phase is set to "phase E" at step S54. Then, at step S55, the ON/OFF states of the individual tracks at the current shift phase are indicated to the shifted-from and shifted-to pattern readout sections 25 and 26. Note that if the style where the current shifted-from style is set as a shifted-to style could not be found by the search at the time of determination of the shifted-from style (step S51), no new shifted-from style is determined so that no performance style shift takes place. Further, if a plurality of the style data sets have been listed as shifted-from style candidates, any one of the style data sets is selected and determined as the shifted-from style.

Namely, according to the example of FIG. 8C, when a further negative performance style shift instruction is given after the shift phase has been moved back to "phase 0" (initial phase), a search is made for a style where the current shifted-from style is set as a shifted-to style and the searched-for style is set as a new shifted-from style, and the latest shifted-from style is set as a new shifted-to style. In this way, even when the performance style shift has been completed up to the first to-be-shifted track, only giving a performance style shift instruction for moving back the shift phase allows the performance to be continued with the performance style shift advanced to a further next shifted-from style data set. In this case, because a given style data set where the current shifted-from style is set as a shifted-to style is determined as a new shifted-from style, the performance can be moved back even when there is no record of performance style shift progress or even in a case where there is such record of performance style shift progress but the performance has already been moved back to the first style data set.

Figure 9:
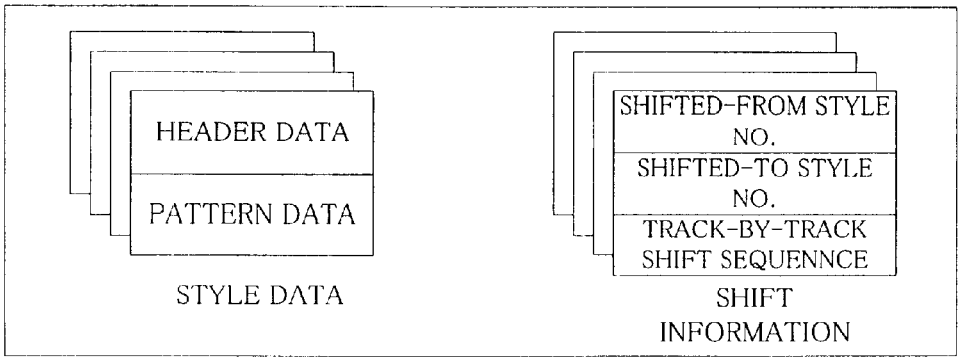
FIG. 9 is a block diagram conceptually showing an exemplary organization of style data with performance style shift information stored separately therefrom.

Whereas the style data sets have been described above as including the performance style shift information within the respective header data (see FIG. 2), each piece of such performance style shift information may be stored, separately from the corresponding style data set, in the ROM, RAM, external storage medium or the like. FIG. 9 shows a modified example of organization of the style data sets, where the performance style shift information is separated from the corresponding style data set.

As shown in FIG. 9, each of the style data sets comprises header data and pattern data. The header data are parameter data common to the succeeding pattern data and include, for example, data indicative of the style number and name, musical time. The pattern data include a plurality of tracks which correspond to a plurality of performance parts such as drum, bass and chord-backing parts. The performance style shift information represent shifted-from and shifted-to style numbers and track-by-track shift sequence. The shifted-from style number represents a style data set from which a performance is to be shifted to another style data set. By thus storing the style data sets and the performance style shift information separately from each other, the performance style shift information can be set independently without having to changing the corresponding style data, as compared to the above-described case where the performance style shift information is included in the style data set, which allows the user to create any desired combinations of the shifted-from and shifted-to styles and desired track-by-track shift sequence as will be described in detail in relation to a shift information creation process.

Figure 10:
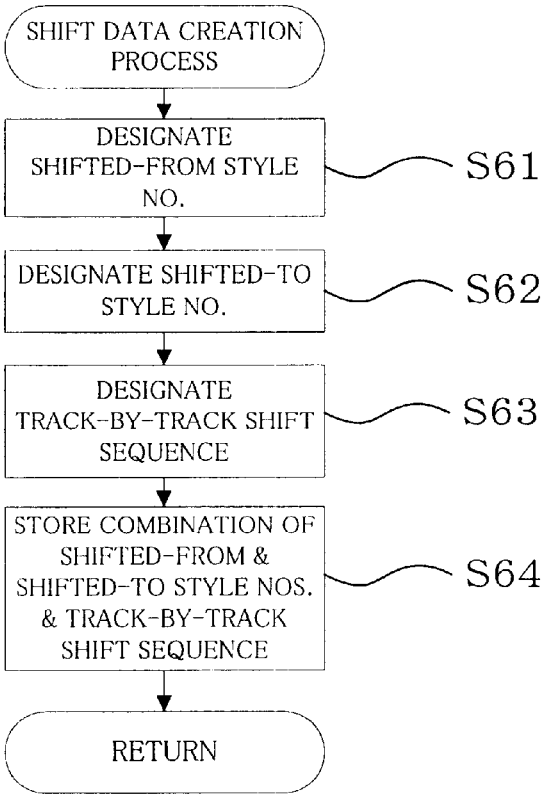
FIG. 10 is a flow chart showing an example of a shift information creation process.

It should also be appreciated that a plurality of pieces of performance style shift information, rather than just one piece of performance style shift information, may be provided for each one of the style data sets. In such a case, the user is allowed to determine a shifted-to style data set and track-by-track shift sequence by selecting any desired one of the pieces of performance style shift information. Further, for each one of the style data sets, there may be stored a plurality of pieces of performance style shift information which share same shifted-from and shifted-to styles but just differ in track-by-track shift sequence. The performance style shift information is created by the shift information creation process as flowcharted in FIG. 10.

The user designates a desired shifted-from style number, shifted-to style number and track-by-track shift sequence at steps S61, S62 and S63, respectively. In accordance with such user designation, a combination of the desired shifted-from style number, shifted-to style number and track-by-track shift sequence is stored as performance style shift information at step S64.

Note that instead of creating entirely new performance style shift information as mentioned above, existing performance style shift information may be copied and then partly modified to provide new performance style shift information. In this way, new performance style shift information similar to the existing performance style shift information can be readily created with no possibility of the existing performance style shift information being destroyed.

Figure 11A:
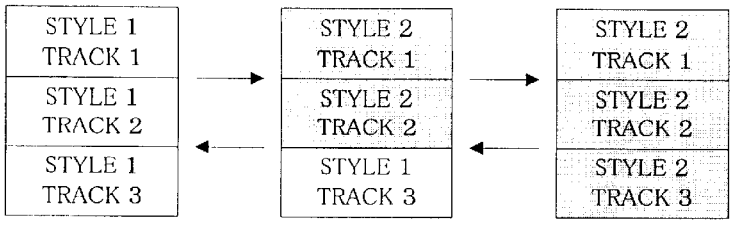
FIG. 11A is a diagram explanatory of a pattern shift scheme which is arranged to effect a performance style shift collectively for a plurality of tracks.
Figure 11B:
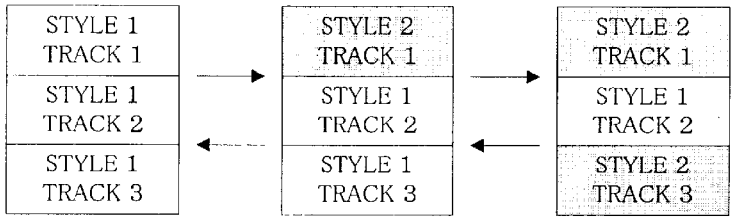
FIG. 11B is a diagram explanatory of another pattern shift scheme which is arranged to leave one or more of the tracks unshifted to a new performance style even after a final shift phase has been reached.
Figure 11C:
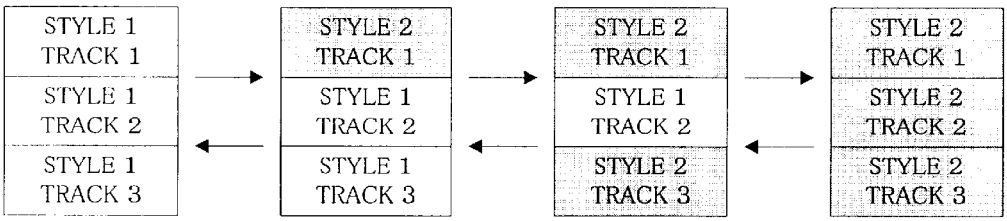
FIGS. 11C–11E are diagrams explanatory of still other pattern shift schemes which are arranged to determine track-by-track shift sequence in a random fashion.
Figure 11D:
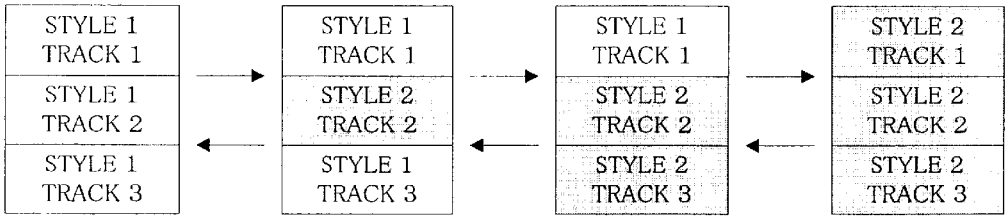
Figure 11E:
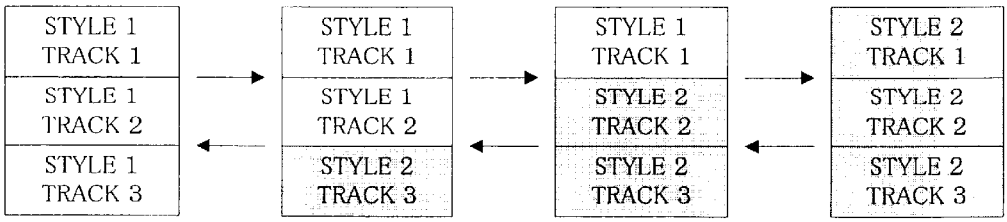
Figure 12:
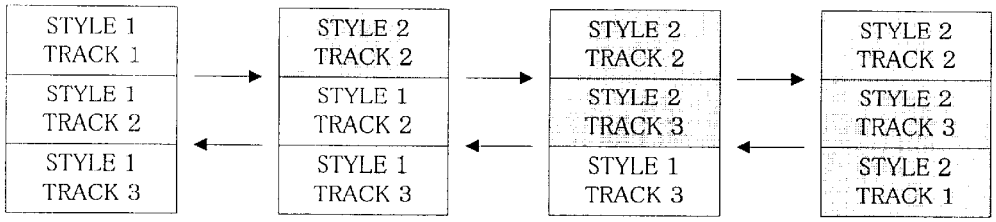
FIG. 12 is a diagram showing still another pattern shift scheme where the track-by-track shift sequence is set such that tracks to which shifted-from and shifted-to performance styles are allocated to different types of tracks.
Figure 13:
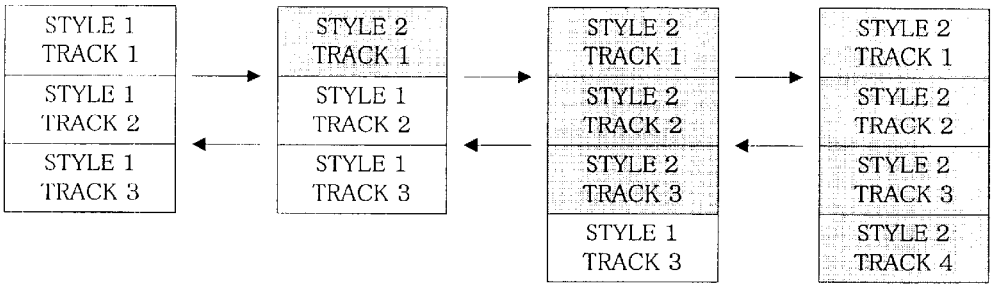
FIG. 13 is a diagram showing still another pattern shift scheme where the track-by-track shift sequence is set such that shifted-from and shifted-to performance styles are allocated to different numbers of tracks.

FIGS. 11–13 are diagrams conceptually showing how a pattern shift is effected for each different track-by-track shift sequence. Note that FIGS. 11 and 12 show examples where shifted-from and shifted-to styles have the same number of tracks (three tracks in the illustrated example), while FIG. 13 shows an example where shifted-from and shifted-to styles have different numbers of tracks (three tracks and four tracks in the illustrated example).

More specifically, FIG. 11A shows an exemplary pattern shift scheme applied to a case where the track-by-track shift sequence is set so as to allow the tracks to be shifted in performance style collectively; more specifically, the track-by-track shift sequence is set here as "1 and 2→3". In this case, as the shift phase is changed to "phase 1", track 1 and track 2 are simultaneously shifted to style 2, and as the shift phase is changed from "phase 1" to "phase E", remaining track 3 is shifted to style 2. By thus simultaneously changing the performance style allocation to a plurality of the tracks per performance style shift instruction, even a great number of tracks can be efficiently shifted in performance style by a reduced number of performance style shift instructions.

FIG. 11B shows another exemplary pattern shift scheme applied to a case where the track-by-track shift sequence is set such that one of the tracks is left unshifted in performance style even after the last shift phase ("phase E") has been reached; more specifically, the track-by-track shift sequence is set here as "1→3". In this case, track 1 is shifted to style 2 as the shift phase is changed to "phase 1" and track 3 is shifted to style 2 as the shift phase is changed from "phase 1" to "phase E", with track 2 left unshifted from style 1. By thus providing a track that is left unshifted in performance style even after the last shift phase has been reached, the instructed performance style shift can be completed with the contents of the shifted-from style data set maintained.

FIGS. 11C–11E show exemplary pattern shift schemes applied to a case where the track-by-track shift sequence is determined randomly (e.g., set as "ransom") so that each track to be shifted is determined randomly. In this case, as the shift phase advances to "phase 1", a randomly selected track is shifted to style 2. Track 1 is selected in the example of FIG. 11C, track 2 is selected in the example of FIG. 11D, and track 3 is selected in the example of FIG. 11E. Then, as the shift phase advances from "phase 1" to "phase 2", another track, selected randomly from among those left unshifted at "phase 1", is shifted to style 2. Specifically, in the illustrated examples of FIGS. 11C and 11D, track 3 is selected to shift to style 2, and in the example of FIG. 11E, track 2 is selected to shift to style 2. Further, as the shift phase advances from "phase 2" to "phase E", the other track, left unshifted at "phase 1" and "phase 2", is shifted to style 2. Specifically, in the example of FIG. 11C, track 2 is shifted to style 2, and in the examples of FIGS. 11D and 11E, track 1 is shifted to style 2. By thus randomly determine each track to be shifted in performance style, it is possible to achieve pattern shifts rich in variety.

FIG. 12 shows another exemplary pattern shift scheme applied to a case where the track-by-track shift sequence is set such that shifted-from and shifted-to tracks differ from each other in track number; in the illustrated example, the shift sequence is set as "1→1, 2→3 and 3→1". In this case, as the shift phase advances to "phase 1", track 1 changes to track 2 and is also shifted to style 2. Thus, the performance part corresponding to track 1 is not performed, and two performance parts are simultaneously performed for track 2. Then, as the shift phase advances from "phase 1" to "phase 2", track 2 changes to track 3 and is also shifted to style 2. Further, as the shift phase advances from "phase 2" to "phase E", track 3 changes to track 1 and is also shifted to style 2.

FIG. 13 shows still another exemplary pattern shift scheme applied to a case where the track-by-track shift sequence is set such that shifted-from and shifted-to tracks differ in the number of tracks. In the illustrated example, the track-by-track shift sequence is set as "1→1, 2→2, 3 and 3→4". In this case, as the shift phase advances to "phase 1", track 1 changes to style 2. Then, as the shift phase advances from "phase 1" to "phase 2", track 2 changes to track 2 and track 3 and is shifted to style 2. Further, as the shift phase advances from "phase 2" to "phase E", track 3 changes to track 4 and is also shifted to style 2.

By thus setting the shifted-from and shifted-to tracks to not correspond to each other, it is possible to execute a complex performance where, for example, the bass part of a shifted-to style is performed with the bass part of a shifted-from style left intact.

Figure 14A:
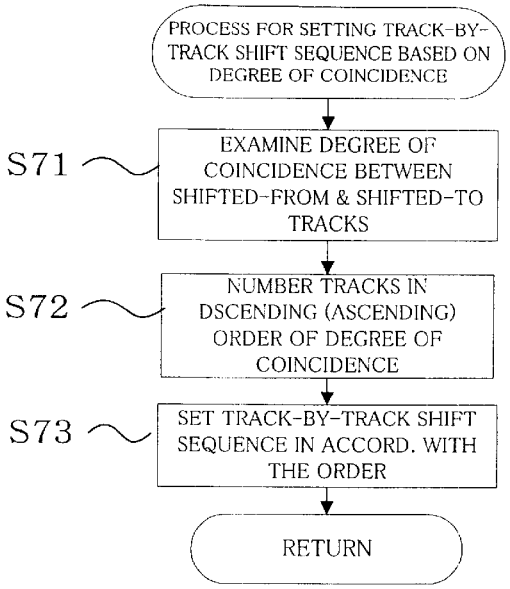
FIG. 14A is a flow chart showing an example of a track-by-track shift sequence determination process which is arranged to examine a degree of coincidence between the style data of the tracks to which the shifted-from and shifted-to performance styles are allocated and determine track-by-track shift sequence on the basis of the degree of coincidence.
Figure 14B:
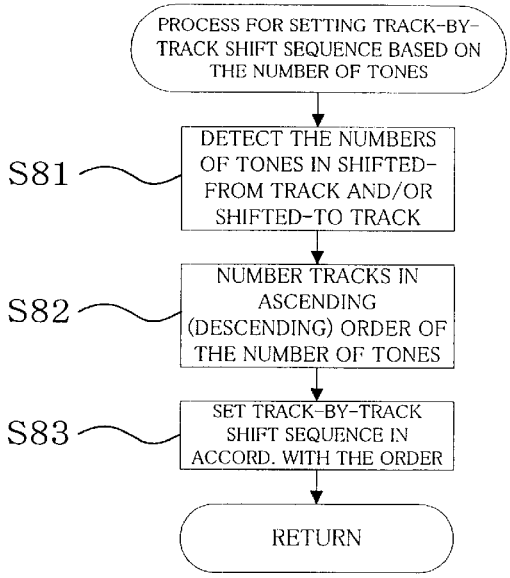
FIG. 14B is a flow chart showing another example of the track-by-track shift sequence determination process which is arranged to detect the number of tones in each of the tracks to which the shifted-from and shifted-to performance styles are allocated and determine track-by-track shift sequence on the basis of the detected number of tones.
Figure 14C:
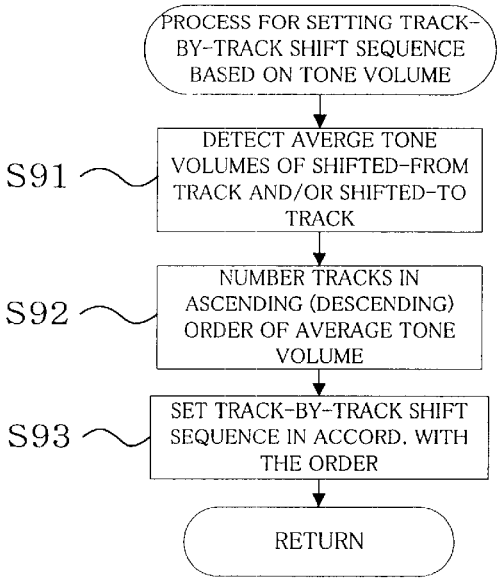
FIG. 14C is a flow chart showing still another example of the track-by-track shift sequence determination process which is arranged to detect an average tone volume of each of the tracks to which the shifted-from and shifted-to performance styles are allocated and determine track-by-track shift sequence on the basis of the detected average tone volume.

Now, a description will be made about a process for determining track-by-track shift sequence by examining the contents of the performance data of the individual tracks, with reference to FIGS. 14A–14C showing flow charts of examples of the track-by-track shift sequence determination process.

FIG. 14A shows an example of the track-by-track shift sequence determination process which is arranged to examine a degree of coincidence between the style data of shifted-from and shifted-to tracks and determine track-by-track shift sequence such that the track-by-track shift takes place in a descending (or ascending) order of the degree of coincidence. First, at step S71, a degree of coincidence between the style data of the shifted-from and shifted-to tracks (i.e., tracks to which shifted-from and shifted-to patterns are allocated) is examined, for example, on the basis of parameters such as the number of tones, pitch variation tendency and/or pitch range. Then, the individual tracks are assigned serial numbers in the descending (or ascending) order of the degree of coincidence at step S72, and track-by-track shift sequence is set in accordance with the assigned numbers of the tracks at step S73. If the track-by-track shift sequence is set in the descending order of the degree of coincidence, the pattern variation is allowed to be not so appreciable at the first shift phase but gradually become appreciable as the shift phase advances, so that human listeners can enjoy little-by-little performance shifts. Conversely, if the track-by-track shift sequence is set in the ascending order of the degree of coincidence, then the pattern variation is allowed to be considerably great at the first shift phase, so that human listeners can enjoy dramatic performance shifts.

FIG. 14B shows another example of the track-by-track shift sequence determination process which is arranged to detect the number of tones in each of the shifted-from and shifted-to tracks and determine track-by-track shift sequence such that the track-by-track shift takes place in an ascending (or descending) order of the detected number of tones. First, the total number of tones in each of the shifted-from and shifted-to tracks is detected at step S81. Note that the detection of the total number of tones may be performed for only one of the shifted-from track and shifted-to tracks. In the case where the respective numbers of tones in both of the shifted-from track and shifted-to tracks are detected, a combination (e.g., average) of the numbers of tones in the shifted-from track and shifted-to tracks is used here. Then, the individual tracks are assigned serial numbers in the ascending (or descending) order of the number of tones at step S82, and track-by-track shift sequence is set in accordance with the assigned numbers of the tracks at step S83. If the track-by-track shift sequence is set in the ascending order of the number of tones, the pattern variation is allowed to be not so appreciable at the first shift phase but gradually become appreciable as the shift phase advances, so that human listeners can enjoy little-by-little performance shifts. Conversely, if the track-by-track shift sequence is set in the descending order of the number of tones, then the pattern variation is allowed to be considerably great at the first shift phase, so that human listeners can enjoy dramatic shifts.

Further, FIG. 14C shows still another example of the track-by-track shift sequence determination process which is arranged to detect an average tone volume of each of the shifted-from and shifted-to tracks and determine track-by-track shift sequence such that the track-by-track shift takes place in an ascending (or descending) order of the detected tone volume. First, the average tone volume of the shifted-from and shifted-to tracks is detected at step S91. Note that the detection of the tone volume may be performed for only one of the shifted-from track and shifted-to tracks. In the case where the respective tone volumes of both of the shifted-from track and shifted-to tracks are detected, a combination (e.g., average) of the tone volumes of the shifted-from track and shifted-to tracks is used here. Then, the individual tracks are assigned serial numbers in the ascending (or descending) order of the average tone volume at step S92, and track-by-track shift sequence is set in accordance with the assigned numbers of the tracks at step S93. If the track-by-track shift sequence is set in the ascending order of the average tone volume, the pattern variation is allowed to be not so appreciable at the first shift phase but gradually become appreciable as the shift phase advances, so that human listeners can enjoy little-by-little performance shifts. Conversely, if the track-by-track shift sequence is set in the descending order of the average tone volume, then the pattern variation is allowed to be considerably great at the first shift phase, so that human listeners can enjoy dramatic performance shifts. By thus determining the track-by-track shift sequence on the basis of examination of the contents of the shifted-from and shifted-to tracks, very natural performance shifts are permitted.

Figure 15B:
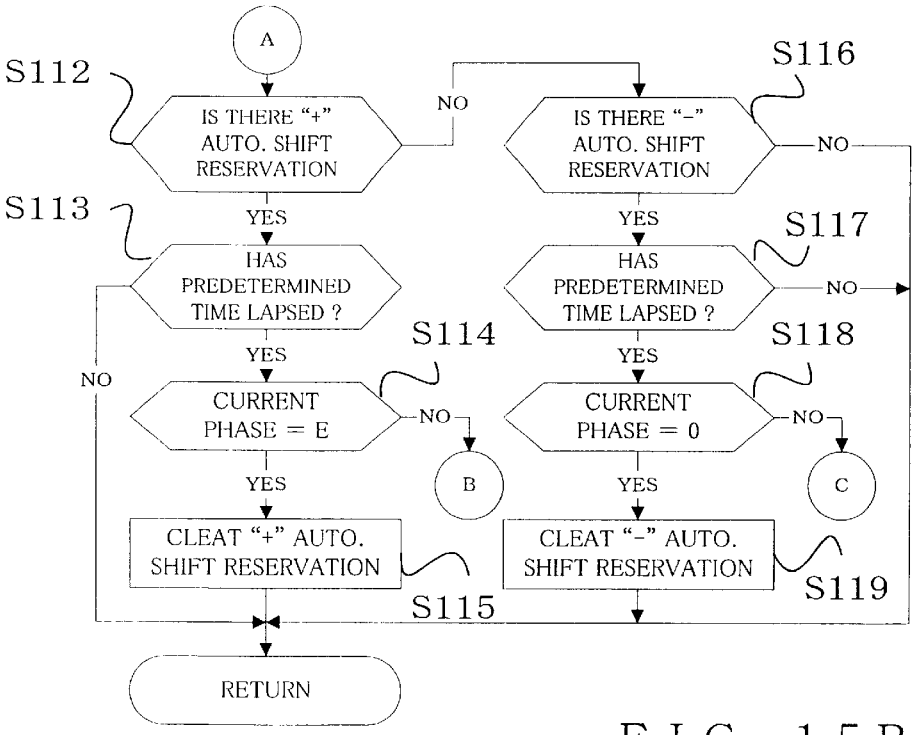
FIG. 15B is a flow chart showing a latter half of the automatic shift control process.
Figure 15A:
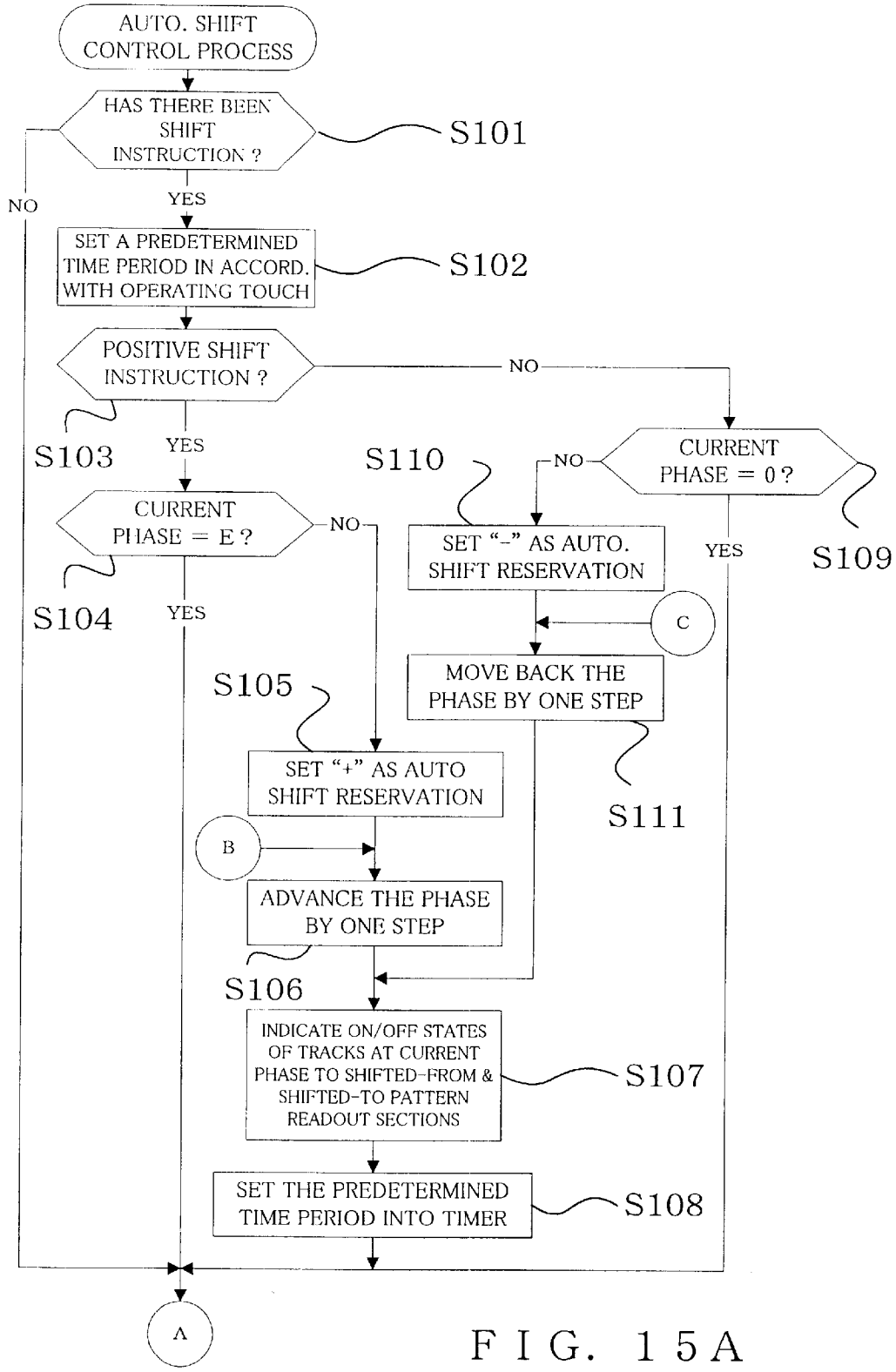
FIG. 15A is a flow chart showing a former half of an automatic shift control process.

Next, a description will be made about an automatic shift control process for automatically advancing the performance style shift every predetermined period (e.g., every measure or every two beats) in response to only a single performance style shift instruction. FIG. 15 is a flow chart showing an example of the automatic shift control process; specifically, FIG. 15A shows a former half of the automatic shift control process while FIG. 15B shows a latter half of the process. Note that the rate (period) at which the performance style shift advances may be made variable. For example, the rate (period) at which the performance style shift advances may be preset or variably set in accordance with a form of a user's performance style shift instruction (such as intensity of an operating touch on a predetermined operator).

First, at step S101, a determination is made as to whether or not a performance style shift instruction has been given via a user operation of the predetermined operator. If there has been no such performance style shift instruction (NO determination at step S101), the automatic shift control process jumps to step S112. If, however, such a performance style shift instruction has been given (YES determination at step S101), a predetermined time period is set, at step S102, in accordance with the user's operating touch. For example, if the user's operating touch intensity is greater than a predetermined value, a one-measure length is set as the predetermined time period, but if the user's operating touch intensity is smaller than a predetermined value, a two-beat length is set as the predetermined time period. Of course, in the case where the predetermined time period is fixed or preset, the operation of step S102 is not necessary. If the given performance style shift instruction is a positive performance style shift instruction as determined at step S103 and the current shift phase is "phase E" (YES determination at next step S104), then the automatic shift control process proceeds to step S112 of FIG. 15B. If the current shift phase is not "phase E" (NO determination at step S104), "+" is set as an automatic shift reservation at step S105, and the current shift phase is advanced by one step, i.e. to the immediately-following phase at step S106. Then, respective ON/OFF states of the individual tracks at the current shift phase are indicated to the shifted-from and shifted-to pattern readout sections 25 and 26, at step S107. Also, the predetermined time period is set into the timer at step S108.

If, on the other hand, the given performance style shift instruction is a negative performance style shift instruction and the current shift phase is "phase 0" (NO determination at next step S103 and YES determination at step S109), then the process proceeds to step S112 of FIG. 15B. If the current shift phase is not "phase 0" (NO determination at step S109), "–" is set as the automatic reservation at step S110, and the current shift phase is moved back by one step, i.e. to the immediately-preceding phase at step S111. After that, the automatic shift control process goes to step S107.

Thereafter, at step S112, a determination is made as to whether the automatic performance style shift reservation has been made as "+" or not. With an YES determination at step S112, the "+" automatic performance style shift reservation is cleared at step S115 if the predetermined time period has lapsed and the current shift phase is "phase E" (i.e., if an YES determination is made at each of steps S113 and S114). In case the current shift phase is not "phase E" as determined at step S114, the process reverts to step S106.

If, on the other hand, the automatic performance style shift reservation has been made as "–" (with a NO determination at step S112 and an YES determination at step S116) and if the predetermined time period has lapsed and the current shift phase is "phase 0" (i.e., with an YES determination at each of steps S117 and S118), the "–" automatic performance style shift reservation is cleared at step S119. In case the current shift phase is not "phase 0" as determined at step S118, the process reverts to step S111.

Because the automatic shift control process allows the performance style shift to be effected over a plurality of shift phases in response to only a single performance style shift instruction, the process can significantly reduce the burden on the user.

Figure 16:
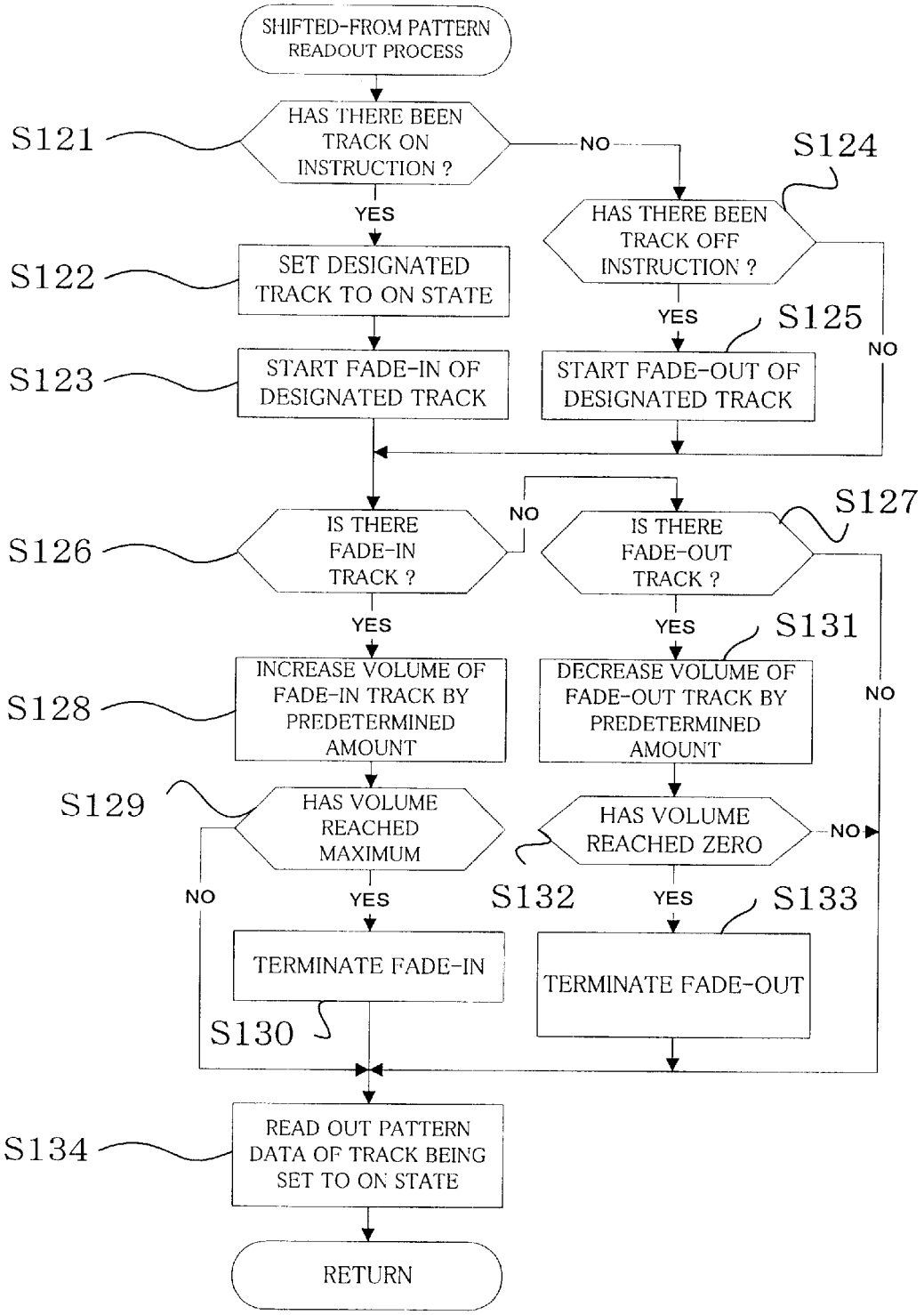
FIG. 16 is a flow chart showing an example of a shifted-from pattern readout process which is arranged to perform a cross-fade waveform synthesis process during the pattern readout.

The following paragraphs describe an example where a cross-fade waveform synthesis process is carried out during a change from a shifted-from style to a shifted-to style. FIG. 16 is a flow chart showing an example of a shifted-from pattern readout process which is arranged to perform the cross-fade waveform synthesis process during the pattern readout. Note that although a shifted-to pattern readout process is also required for the cross-fade waveform synthesis process, description of the shifted-to pattern readout process is omitted here because it is substantially similar to the shifted-from pattern readout process.

First, at step S121, a determination is made as to whether there has been given an instruction for setting a particular track to the ON state (track ON instruction). With an YES determination at step S121, the particular or designated track is set to the ON state at step S122, and a fade-in operation is initiated on the particular track at step S123. If there has been no track ON instruction but there has been a track OFF instruction (i.e., with a NO determination at step S121 and an YES determination at step S124). Then, a fade-out operation is initiated on the track to which the track OFF instruction has been directed, at step S125. Then, it is determined at step 126 whether there is a fade-in track, and it is determined at step 127 whether there is a fade-out track. If there is a fade-in track as determined at step S126, the tone volume of the fade-in track is increased by a given amount at step S128; this given amount may be preset, or set as necessary by the user. More particularly, the given amount may be set in accordance with intensity of a user's operating touch on the shift instructing operator. Then, once the tone volume has been increased to a maximum level as determined at step S129, the fade-in operation is terminated. The maximum tone volume level is one previously set for that track; for example, the maximum tone volume level for the track is "90" if "90" is previously set.

On the other hand, if there is a fade-out track as determined at step S127, the tone volume of the fade-out track is decreased by a given amount at step S131. Then, once the tone volume has been increased to a zero level as determined at step S132, the fade-out operation is brought to an end and the track in question is set to the OFF state at step S133. At next step S134, a pattern readout operation is performed on the track having been set to the ON state.

By thus performing the cross-fade waveform synthesis between the shifted-from and shifted-to patterns, the performance style shift can be effected smoothly.

Figure 17:
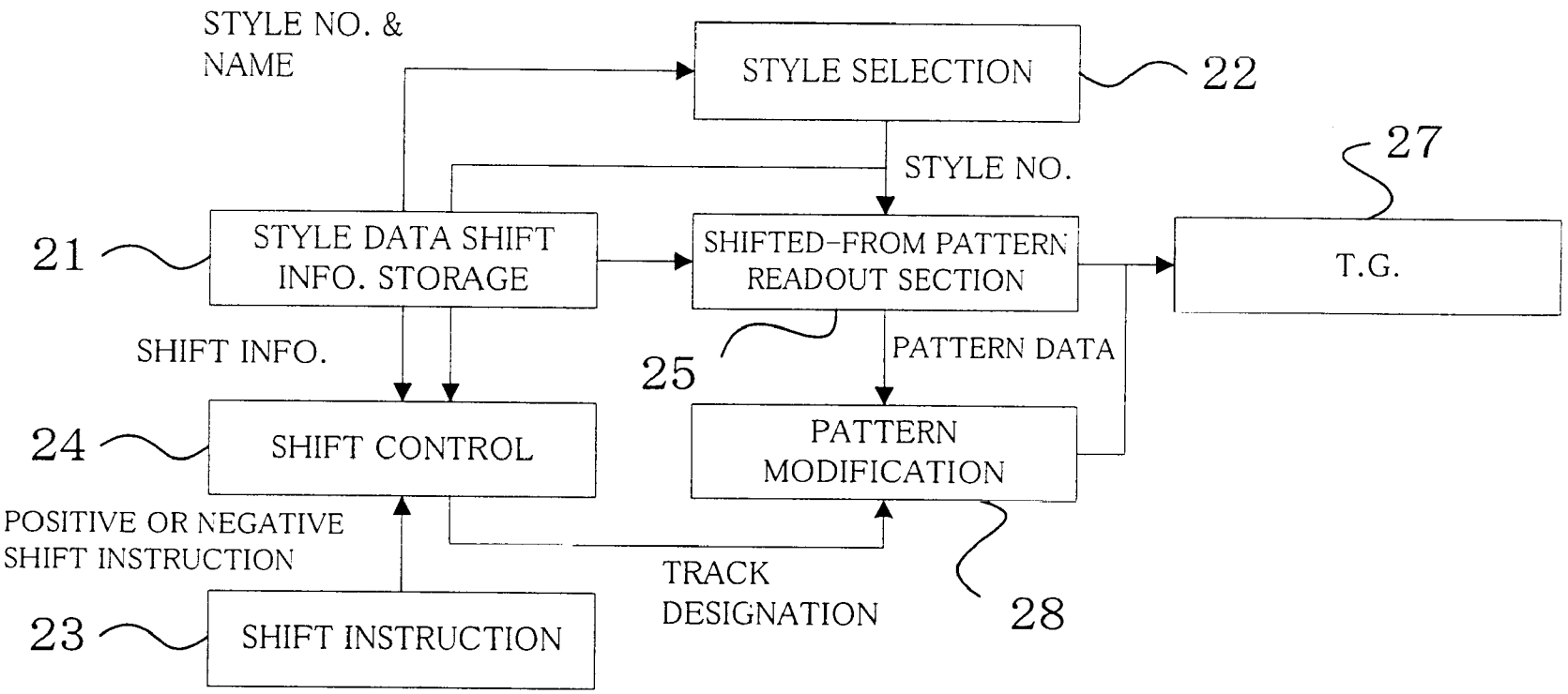
FIG. 17 is a conceptual functional block diagram of another embodiment of the performance control apparatus which is constructed to modify a shifted-from pattern in accordance with a predetermined algorithm.

FIG. 17 is a conceptual functional block diagram of another embodiment of the performance control apparatus which is constructed to provide a shifted-to pattern by modifying a shifted-from pattern in accordance with a predetermined algorithm t, instead of changing from one pattern to another.

In the embodiment of FIG. 17, track-by-track shift sequence data and modification type data are stored as the performance style shift information. Pattern modification section 28 contains a plurality of different modification algorithms and modifies a designated shifted-from pattern on the basis of one of the modification algorithms which corresponds to a designated modification type. Here, each time a performance style shift instruction is given, the pattern data of a particular track, to which the performance style shift instruction is directed, may be modified. Alternatively, modified pattern data may be prestored for all the tracks so that each time a performance style shift instruction is given, the modified pattern data of a particular track, to which the performance style shift instruction is directed, can be read out. By thus providing a shifted-to style data set by modifying a shifted-from style data set, there can be provided a performance style shift to novel style data other than the existing performance data.

In the above-mentioned manner, the user is allowed to give a performance style shift instruction by means of the shift instruction section 23 when the user wants a performance executed in a different performance style from the currently performed (reproduced) performance style. Once the performance style shift instruction is given, the shift control section 24 starts performing control such that the currently reproduced performance style is sequentially shifted to a shifted-to performance style, on a performance-part-by-performance-part (track-by-track) basis, in accordance with predetermined shift sequence. At that time, the pattern modification section 28 creates performance data of the shifted-to performance style by modifying the performance data of the currently reproduced performance style. In this way, the performance data of the shifted-to performance style can be made to coincide with the performance data of the currently reproduced performance style in terms of fundamental musical characteristics. That is, by modifying only part of the performance data of the currently reproduced performance style to create the performance data of the shifted-to performance style, considerable consistency can be maintained between the performance data of the currently reproduced performance style and the shifted-to performance style. For example, in a situation where one or more of the musical characteristics appearing in individual phrases and measures, such as a pitch pattern or rhythm patter, of the currently reproduced performance style are to be used as they are, it is only necessary to modify part of the performance data of the currently reproduced performance style. Also, the modification of the currently reproduced performance style allows the performance style shift to be made to a novel style data set other than the existing performance data Whereas the preferred embodiments have been described above in relation to the case where the performance parts include drum, bass and chord-backing parts, the present invention is not so limited and may be applied only to the drum part comprising a plurality of drum instruments.

Further, every shifted-from and shifted-to style numbers may be visually shown on a display, for example, in the form of a liquid crystal display (LCD) panel, cathode ray tube (CRT) or the like. Further, the track number of each track being shifted in performance style, or each track being performed (or not being performed) in a shifted-from or shifted-to style may be visually shown on a display or the like.

Sifted-from and shifted-to pattern data may differ from each other in the number of measures; for example, the shifted-from pattern data may have two measures and the shifted-to pattern data may have four measures. In this case, two kinds of pattern data differing from each other in the number of measures would mixedly reside in tracks being subjected to a pattern shift, but such mixed residence would only present a difference in repetition cycle and would not result in any significant performance problems.

The electronic musical instrument for use with the present invention may be of any other type than the keyboard instrument, such as a stringed, wind or percussion instrument. Further, whereas the preferred embodiments have been described above in relation to the electronic musical instrument in which the tone generator device, automatic composition device, etc. are incorporated together, it should be obvious that the present invention is not so limited and can be applied to electronic musical instruments where the tone generator device, automatic composition device, etc. are separated from each other and connected via communication means such as a MIDI interface and communication network. Furthermore, the electronic musical instrument may be composed of a personal computer and software, in which case processing programs may be supplied from storage media, such as a magnetic disk, optical disk or semiconductor memory, or via a communication network. Moreover, the present invention may be applied to creation of music piece data to be used in a karaoke apparatus, or to an automatic performance apparatus such as a player piano.

It should also be appreciated that the performance data employed in the present invention may be in any desired format, such as: the "event plus absolute time" format where the time of occurrence of each performance event is represented by an absolute time within a music piece or a measure; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. In the case where performance data of a plurality of channels are involved, they may be stored either in a mixed fashion or separately on a track-by-track basis. Furthermore, the automatic performance data may be processed by any desired scheme, such as one where processing cycles thereof are varied according to a currently-set performance tempo, one where values of automatic performance timing data are varied according to a currently-set performance tempo with the processing cycles held constant, or one where a manner of counting the automatic performance timing data in each process is varied according to a currently-set performance tempo with the processing cycles held constant.

In summary, the present invention is characterized primarily by allowing each performance part to be performed in a different performance style. Thus, the present invention achieves the benefits that performance data can be gradually shifted for each of the performance parts and thereby there can be obtained natural performance-style shifts free of musical inconveniences.

Further, because the present invention allows the user to freely set a performance style shift, the performance style shift can be effected just as intended by the user.

What is claimed is:

1. A performance control apparatus comprising:

a memory storing performance data for a plurality of performance parts in association with a plurality of performance styles;

an instruction generator adapted to issue a performance style shift instruction, said shift instruction for shifting a currently-reproduced performance style to another performance style; and a processor coupled with said memory and said instruction generator, and adapted to:

read out, from said memory, the performance data that correspond to a desired one of the performance styles and reproduce performance tones of the plurality of the performance parts on the basis of the read-out performance data; and replace, at a first shift phase in response to the performance style shift instruction, the performance data of one or more, but not all, of the performance parts of the currently-reproduced performance style with the performance data of one or more, but not all, of the performance parts of a shifted-to performance style, and replace, at a shift phase subsequent to said first shift phase, the performance data of another one or more, but not all, of the performance parts of the currently-reproduced performance style with the performance data of another one or more, but not all, of the performance parts of the shifted-to performance style, thereby gradually replacing a plurality of the performance parts of the currently-reproduced performance style with the performance parts of the shifted-to performance style.

2. A performance control apparatus as claimed in claim 1 wherein said instruction generator includes an operator, and said processor sequentially advances the shift phase per operation of said operator.

3. A performance control apparatus as claimed in claim 1 wherein said processor sequentially advances the shift phase through said plurality of stepwise shift in response to a single performance style shift instruction issued by said instruction generator.

4. A performance control apparatus as claimed in claim 1 which further comprises a table storing, for each performance style that becomes a shifted-from performance style, information indicating a shifted-to performance style to which the shifted-from performance style is changed over, and wherein a shifted-to performance style is determined by referring to said table in accordance with the currently-reproduced performance style.

5. A performance control apparatus as claimed in claim 1 which further comprises a table storing shift sequence of the performance parts at the plurality of stepwise shift phases, and wherein one of the performance parts that is to be shifted to the performance data of the shifted-to performance style at each of the shift phases is determined by referring to said table.

6. A performance control apparatus as claimed in claim 5 wherein said table stores the shift sequence of the performance parts at the plurality of stepwise shift phases for each of the performance styles, and said table is referred to in accordance with the currently-reproduced performance style.

7. A performance control apparatus as claimed in claim 1 which further comprises a setting device for setting identification information to designate a shifted-to performance style, and wherein a shifted-to performance style corresponding to the currently-reproduced performance style is determined in accordance with the identification information.

8. A performance control apparatus as claimed in claim 1 which further comprises a setting device for setting shift sequence of the performance parts at the plurality of stepwise shift phases, and wherein as the shift phase advances, the performance data of one or more of the performance parts of the currently-reproduced performance style are sequentially replaced with the performance data of one or more of the performance parts of the shifted-to performance style in accordance with the shift sequence set via said setting device.

9. A performance control apparatus as claimed in claim 1 wherein said processor replaces the one or more of the performance parts of the currently-reproduced performance style with one or more of the performance parts of the shifted-to performance style which are different in type from the one or more performance parts of the currently-reproduced performance style.

10. A performance control apparatus as claimed in claim 1 wherein the currently-reproduced performance style and shifted-to performance style differ from each other in a total number of the performance parts.

11. A performance control apparatus as claimed in claim 1 wherein said processor determines shift sequence of the performance parts at random, and wherein as the shift phase advances, said processor sequentially replaces the performance data of one or more of the performance parts of the currently-reproduced performance style with the performance data of one or more of the performance parts of the shifted-to performance style in accordance with the determined shift sequence.

12. A performance control apparatus as claimed in claim 1 wherein said processor determines shift sequence of the performance parts in accordance with the performance parts of the currently reproduced performance style and shifted-to performance style, and wherein as the shift phase advances, said processor sequentially replaces the performance data of one or more of the performance parts of the currently-reproduced performance style with the performance data of one or more of the performance parts of the shifted-to performance style in accordance with the determined shift sequence.

13. A performance control apparatus as claimed in claim 1 wherein said processor replaces the performance data of one or more of the performance parts of the currently-reproduced performance style with the performance data of one or more of the performance parts of the shifted-to performance style in correspondence with predetermined performance timing after issuance of the performance style shift instruction by said instruction generator.

14. A performance control apparatus as claimed in claim 1 wherein said processor determines timing for replacing the performance data of one or more of the performance parts of the currently-reproduced performance style with the performance data of one or more of the performance parts of the shifted-to performance style, depending on which performance timing a time point when the performance style shift instruction has been issued by said instruction generator corresponds to.

15. A performance control apparatus as claimed in claim 1 wherein when all the performance data of the performance parts of the currently reproduced performance style have been replaced with the performance data of the performance parts of the shifted-to performance style, said processor sets the shifted-to performance style as a newly reproduced performance style and determines a next shifted-to performance style in accordance with the identification information corresponding to the newly reproduced performance style.

16. A performance control apparatus as claimed in claim 1 wherein said instruction generator includes an operator capable of moving back the shift phase, and wherein when said operator is operated before a first performance style shift is initiated on the currently-reproduced performance style, said processor determines a performance style to be returned to on the basis of so-far-obtained record of performance style shift progress and sets the performance style to be returned to as a newly reproduced performance style and said currently reproduced performance style as a new shifted-to performance style.

17. A performance control apparatus as claimed in claim 1 wherein said instruction generator includes an operator capable of moving back the shift phase, and wherein when said operator is operated before a first performance style shift is initiated on the currently reproduced performance style, said processor searches for a performance style where the currently-reproduced performance style is being set as a shifted-to performance style and sets the searched-for performance style as a newly reproduced performance style and said currently-reproduced performance style as a new shifted-to performance style.

18. A performance control apparatus as claimed in claim 1 wherein at least one of the performance parts of a shifted-from performance style is left unshifted to the shifted-to performance style even after a performance style shift is completed for all the shift phases.

19. A performance control apparatus as claimed in claim 1 wherein when reproduction of the performance data is to be shifted from a shifted-from performance style to the shifted-to performance style, said processor is adapted to carry out a performance style shift while performing a cross-fade process on the performance data.

20. A performance control apparatus as claimed in claim 1 wherein said processor is adapted to, in response to a single performance style shift instruction issued by said instruction generator, replace two or more, not all, of the performance parts of the currently-reproduced performance style with two or more of the performance parts of the shifted-to performance style.

21. A performance control apparatus as claimed in claim 1 wherein the performance data of one or more of the performance parts of the shifted-to performance style are created by altering the performance data of one or more of the performance parts of the currently-reproduced performance style.

22. A method of reading out performance data corresponding to a particular performance style from a memory storing sets of performance data for a plurality of performance parts in association with a plurality of performance styles and reproducing performance tones of two or more of the performance parts on the basis of the read-out performance data, said method comprising:

issuing a performance style shift instruction for shifting from a currently-reproduced performance style to another performance style;

replacing, at a first shift phase in response to the performance style shift instruction, the performance data of one or more, but not all, of the performance parts of the currently-reproduced performance with the performance data of one or more of the performance parts of a shifted-to performance style; and replacing, at a shift phase subsequent to said first shift phase, the performance data of another one or more, but not all, of the performance parts of the currently-reproduced performance style with the performance data of another one ore more, but not all, of the performance parts of the shifted-to performance style, thereby gradually replacing a plurality of the performance parts of the currently-reproduced performance style with the performance parts of the shifted-to performance style.

23. A machine-readable storage medium containing a group of instructions to cause said machine to implement a method of reading out performance data corresponding to a particular performance style from a memory storing performance data for a plurality of performance parts in association with a plurality of performance styles and reproducing performance tones of two or more of the performance parts on the basis of the read-ut performance data, said method comprising:

issuing a performance style shift instruction for shifting from a currently-reproduced performance style to another performance style;

replacing, at a first shift phase in response to the performance style shift instruction, the performance data of one or more, but not all, of the performance parts of the currently-reproduced performance style with the performance data of one or more, but not all, of the performance parts of a shifted-to performance style; and replacing, at a shift phase subsequent to said first shift phase, the performance data of another one or more, but not all, of the performance parts of the currently-reproduced performance style with the performance data of another one or more, but not all, of the performance parts of the shifted-to performance style, thereby gradually replacing a plurality of the performance parts of the currently-reproduced performance style with the performance parts of the shifted-to performance style.

* * * * *